US006549744B2

(12) United States Patent
Terazawa et al.

(10) Patent No.: US 6,549,744 B2
(45) Date of Patent: Apr. 15, 2003

(54) POWDER CONTAINER FOR AN IMAGE FORMING APPARATUS AND POWDER DISCHARGING DEVICE

(75) Inventors: Seiji Terazawa, Shizuoka (JP); Fumio Ogata, Shizuoka (JP); Goro Katsuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/752,447

(22) Filed: Jan. 3, 2001

(65) Prior Publication Data

US 2001/0017998 A1 Aug. 30, 2001

(30) Foreign Application Priority Data

Jan. 7, 2000 (JP) ..... 2000-001806
Jun. 19, 2000 (JP) ..... 2000-183568

(51) Int. Cl.[7] ..... G03G 15/08

(52) U.S. Cl. ..... 399/262; 222/105; 222/181.1; 222/DIG. 1

(58) Field of Search ..... 399/262, 258, 399/263; 222/DIG. 1, 92, 105, 181.1, 181.2, 185.1

(56) References Cited

U.S. PATENT DOCUMENTS 3,374,929 A * 3/1968 Silfverskiold ..... 222/105
4,113,146 A * 9/1978 Williamson ..... 222/105
5,016,779 A * 5/1991 Williamson ..... 222/105
5,402,915 A * 4/1995 Hogan ..... 222/105
5,426,492 A * 6/1995 Diehl ..... 222/DIG. 1
5,638,989 A * 6/1997 Ophardt et al. ..... 222/105

FOREIGN PATENT DOCUMENTS

| | | |
|---|---|---|
| EP | 0 926 079 | 6/1999 |
| GB | 2 041 318 | 9/1980 |
| JP | 6-274031 | 9/1994 |
| JP | 9-22175 | 1/1997 |
| JP | 11-119536 | 4/1999 |
| JP | 11-282236 | 10/1999 |

* cited by examiner

*Primary Examiner*—Robert Beatty
(74) *Attorney, Agent, or Firm*—Oblon, Spivak, McClelland, Maier & Neustadt, P.C.

(57) ABSTRACT

A powder container for an electrophotographic image forming apparatus includes a deformable bag and a powder discharging portion made up of a tapered portion and a toner outlet. A buckling reducing device reduces the buckling of part of the bag adjoining the tapered portion and toner outlet. The toner container prevents the discharge of powder from being deteriorated by buckling, thereby reducing the amount of powder to be left in the container. Further, a device is provided for maintaining the upright position of the bag. A toner discharging device for discharging the toner from the toner container is also disclosed.

87 Claims, 20 Drawing Sheets

POWDER CONTAINER FOR AN IMAGE FORMING APPARATUS AND POWDER DISCHARGING DEVICE

BACKGROUND OF THE INVENTION

The present invention relates to a powder container applicable to an electrophotographic image forming apparatus for storing toner, or powdery coloring agent, and a device for discharging the toner from the powder container.

A toner container customarily used with a copier or similar electrophotographic apparatus is implemented as a cartridge, bottle or similar hard case. Generally, the toner container is collected from the user's station by a manufacturer and recycled, reused or burned out. In this respect, the hard case has a problem that it is bulky and increases the collection cost.

A toner container whose volume can be reduced has been proposed in the past. However, this kind of toner container cannot stably replenish toner to a developing unit. Also proposed in the past is a toner container whose volume can be reduced only during transport. Even this toner container has a problem that when toner is transferred from the container to a hard bottle or a toner hopper, the toner is scattered around and contaminates the surrounding.

To stably replenish toner to a developing unit, there has been proposed a toner replenishing device that uses a toner container formed of resin, paper or similar flexible sheets and capable of being reduced in volume. The toner container for this application is made up of a deformable bag storing the toner and a box more rigid than the bag and accommodating the bag therein. In this bag-in-box type of toner container, the bag includes a tapered portion and a toner discharging portion including a tapered toner outlet. The tapered portion and toner outlet cause a minimum of toner to be left in the bag. The bag-in-box type of toner container, however, has a problem that when a shock or an impact acts on the container at the time of, e.g., shipment, the bag buckles around the tapered portion and tapered toner outlet due to, e.g., the weight of the toner. This, coupled with the fact that the portion of the bag around the toner outlet is narrow, prevents the toner from being smoothly delivered during operation or causes much toner to be left in the bag.

Moreover, the toner container for the toner replenishing device is usually held in an upright position with the toner outlet facing downward. This brings about another problem that the flexible bag is apt to fall down due to its own weight and stop up the toner outlet. In addition, when a certain amount of toner is delivered from the bag, the creases of the bag fallen down catch the toner and causes more toner to be left in the bag.

Technologies relating to the present invention are disclosed in, e.g., Japanese Patent Laid-Open Publication Nos. 6-274031, 9-22175, 11-119536 and 11-282236.

SUMMARY OF THE INVENTION

It is therefore a first object of the present invention to provide a powder container free from buckling and a powder discharging device using the same.

It is a second object of the present invention to provide a flexible powder container that falls down little even when used in an upright position, and a powder discharging device using the same.

It is a third object of the present invention to provide an image forming apparatus using the above powder container and powder discharging device.

In accordance with the present invention, a powder container for storing powder and allowing the powder to be discharged includes a discharging portion that includes a deformable bag and a tapered portion configured to discharge the powder. A buckle reducing device reduces, when the toner container is held in an upright position with the discharging portion facing downward and being fixed, the buckling of the tapered portion.

Also, in accordance with the present invention, a powder container includes a deformable bag storing powder, and a position maintaining device configured to maintain the position of the bag.

Further, in accordance with the present invention, in a powder discharging device for discharging coloring powder from a powder container via an outlet formed in the container, the powder container includes a deformable bag storing the coloring powder, a position maintaining device configured to maintain the position of the bag, and a mounting portion configured to removably mount the bag. A gas is fed into the bag in order to fluidize the coloring powder and cooperates with the position maintaining device to maintain the position of the bag.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

First, preferred embodiments directed toward the first object of the present invention will be described.

Figure 1:
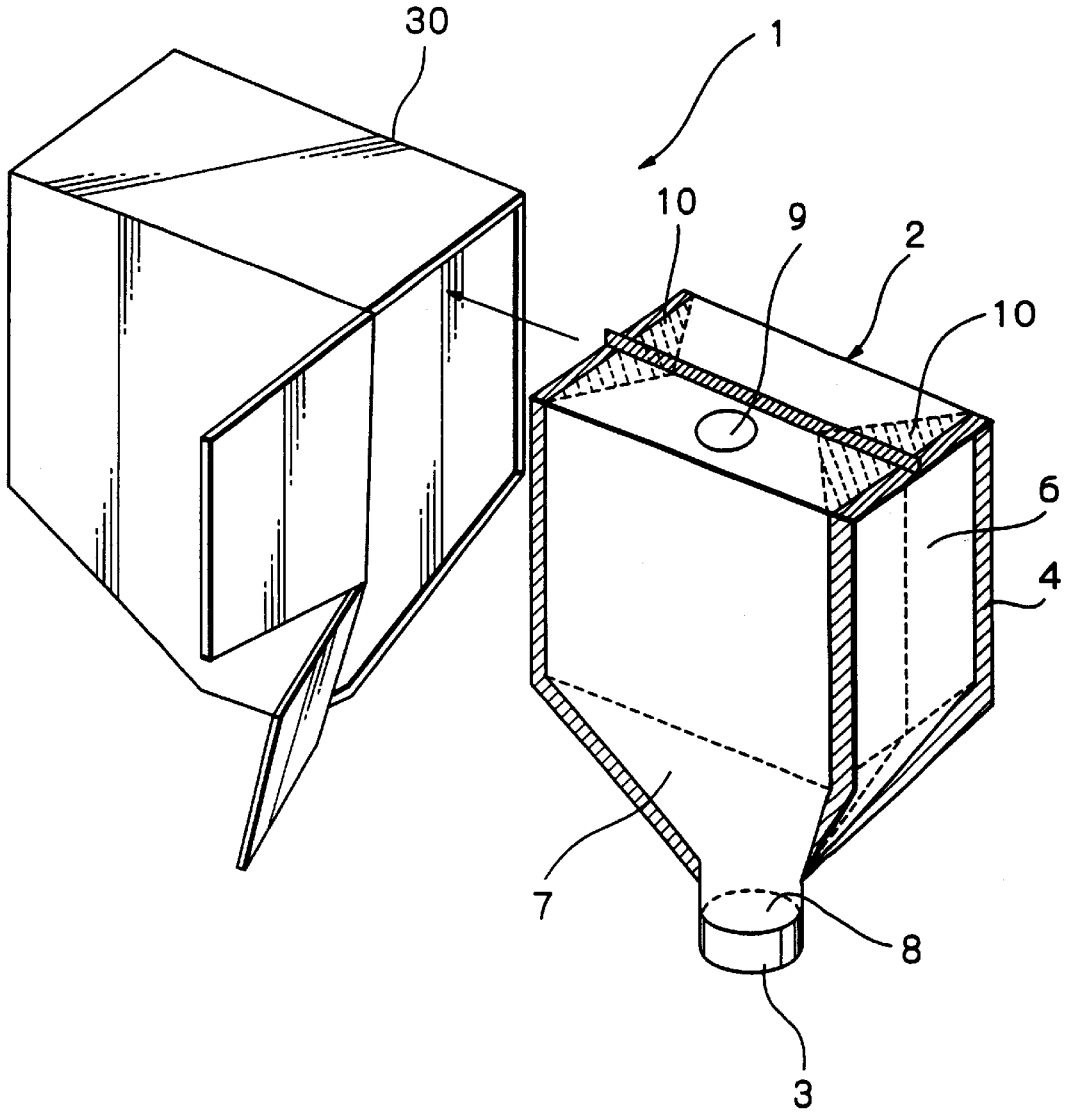
Fig. 1 RELATED ART
FIG. 1 is an isometric view showing a powder container on which the present invention is based.

Referring to FIG. 1, a toner container proposed in the past and on which the present invention is based is shown and generally designated by the reference numeral 1. As shown, the toner container 1 is made up of a deformable bag 2 storing toner and a box 30 more rigid than the bag 2. The toner container 1 has the bag 2 received in the box 30 and is generally referred to as a bag-in-box type toner container.

The bag 2 has a mouth member 3 formed of, e.g., resin and a bag affixed to the mouth member. The mouth member is produced by, e.g., injection molding and formed with a toner outlet. To form the bag, a single flexible sheet of polyethylene, Nylon or similar resin or paper, which may be 80 $\mu$m to 20 $\mu$m thick, or a laminate of such flexible sheets is sealed by heat sealing. A seal valve, not shown, is fitted in the toner outlet of the mouth member 3 and formed of foam sponge or similar material. The bag is made up of a substantially rectangular parallelepiped body portion 6, a pyramidal tapered portion 7 contiguous with the body portion 6, and a cylindrical, tapered toner outlet 8 formed in the end of the tapered portion 7. The tapered portion 7 and toner outlet 8 cause a minimum of toner to be left in the toner container 1. The mouth member 3 is fitted on the end of the toner outlet 8. A filter member 9 is mounted on the body portion 6 and passes air therethrough, but blocks toner.

The toner container 1 in which the box 3 covers the flexible bag 2 is easy to handle. Further, when toner stored in the bag 2 is used up, only the bag 2 should be replaced with a new bag, i.e., the box 30 can be repeatedly used. The toner container 1, however, has the following problem left unsolved.

Figure 3:
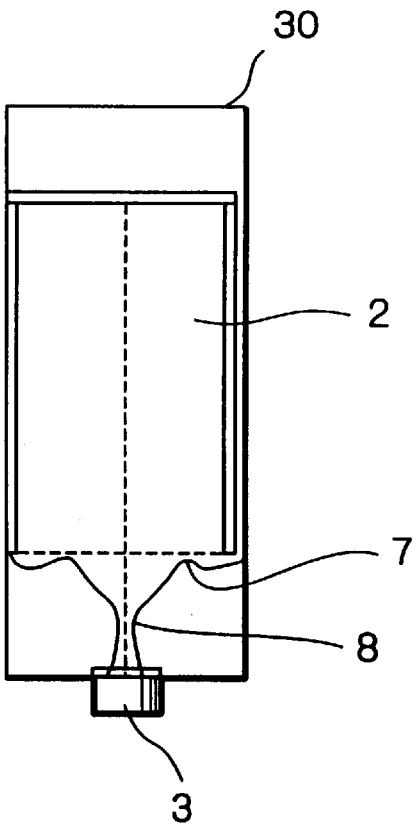
Fig. 3 RELATED ART
FIG. 3 is a view showing how the bag buckles.
Figure 2:
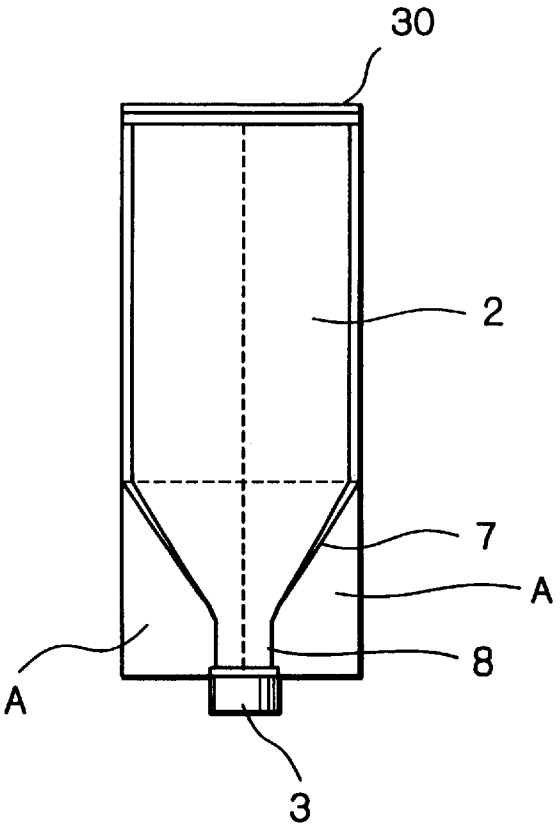
Fig. 2 RELATED ART
FIG. 2 is a view showing a bag included in the toner container received in a box.

Usually, the bag 2 is accommodated in the box 30 in a position shown in FIG. 2. As shown in FIG. 3, when some shock or impact acts on the toner container 1 during transport, the bag 2 is apt to buckle around the tapered portion thereof adjoining the mouth member 3 due to, e.g., the weight of the toner. If the container 1 with the buckled bag 2 is used, the toner outlet is slightly reduced in sectional area due to the deformation. This obstructs smooth toner delivery or causes much toner to be left in the bag 2.

Figure 4:
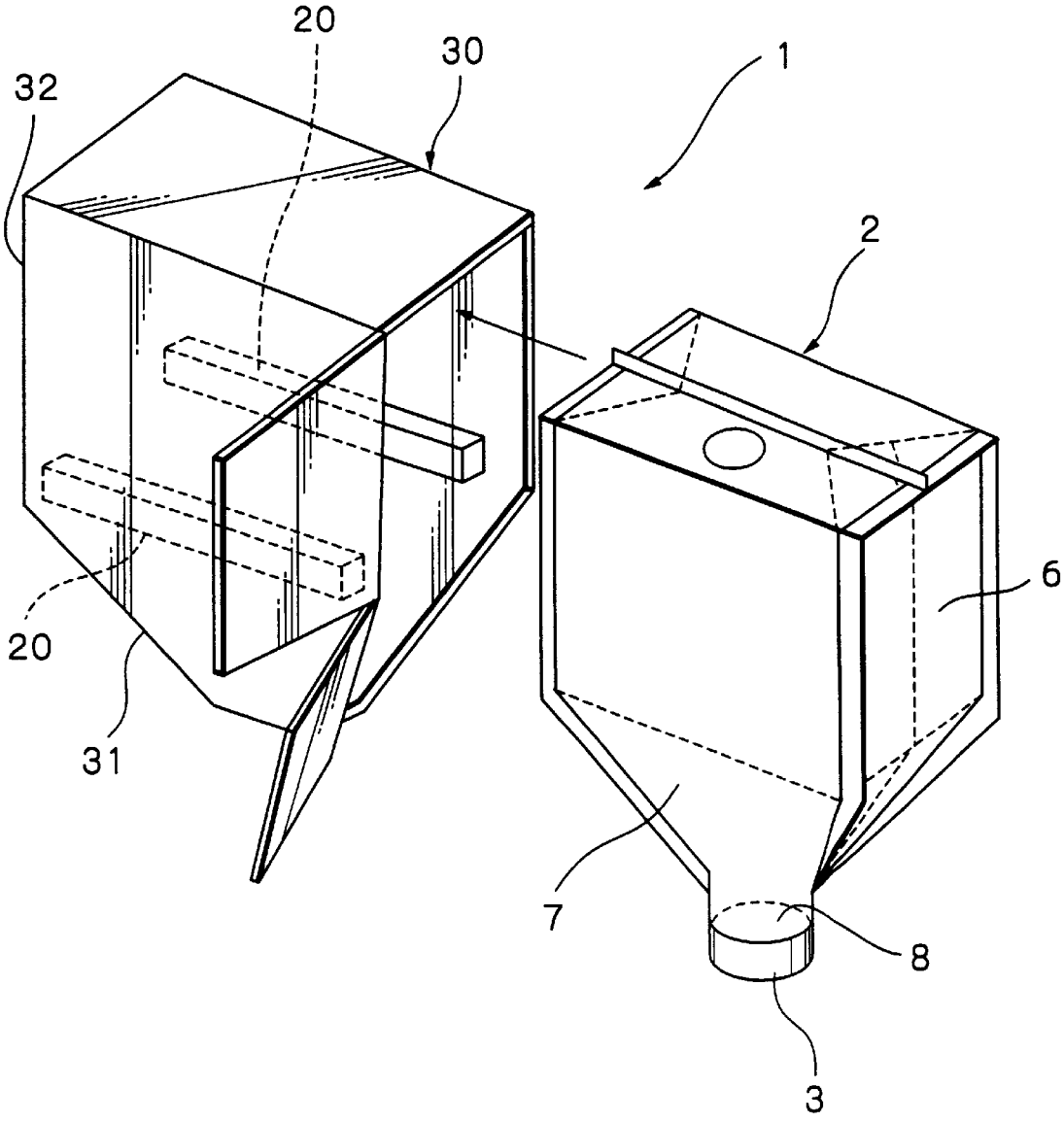
FIG. 4 is a perspective view showing a preferred embodiment of the powder container in accordance with the present invention.

Reference will be made to FIG. 4 for describing a toner container embodying the present invention. As shown, the toner container, generally 1, is similar in structure to the conventional toner container 1 of FIG. 1. Structural elements of FIG. 4 identical with the structural elements of FIG. 1 are designated by identical reference numerals. In the illustrative embodiment, the toner container 1 includes a box 30. Anti-slip members, or buckle reducing means, 20 are fitted on the inner periphery of the box 30 and implemented as ribs. The anti-slip members 20 extend in a direction perpendicular to a direction in which toner is discharged via a toner outlet formed in a mouth member 3. The anti-slip members 20 may be fitted on any position on the inner periphery of the box 30 so long as they can bite into a bag 2 received in the box 30. The anti-slip members 20 should preferably be located at the positions shown in FIG. 4 for the following reasons.

In the illustrative embodiment, the bag 2 includes a tapered portion 7 terminating at a toner outlet 8 and having four walls all of which are pyramidal. On the other hand, in the box 30, only two walls facing each other are tapered, as at 31, halfway in accordance with the tapered portion 7 of the bag 2. The other two walls 32 of the box 30 are entirely vertical. Consequently, as shown in FIG. 2, spaces A exist between the box 30 and the bag 2 received in the box 30. When some shock or impact acts on the toner container 1, the bag 30 buckles more in the spaces A than in the portions where the tapered walls 31 exist. In light of this, to reduce buckling, the anti-slip members 20 should preferably be fitted on the vertical walls 32 in such a manner as to bite into the body portion 6 of the bag 2.

Figure 5:
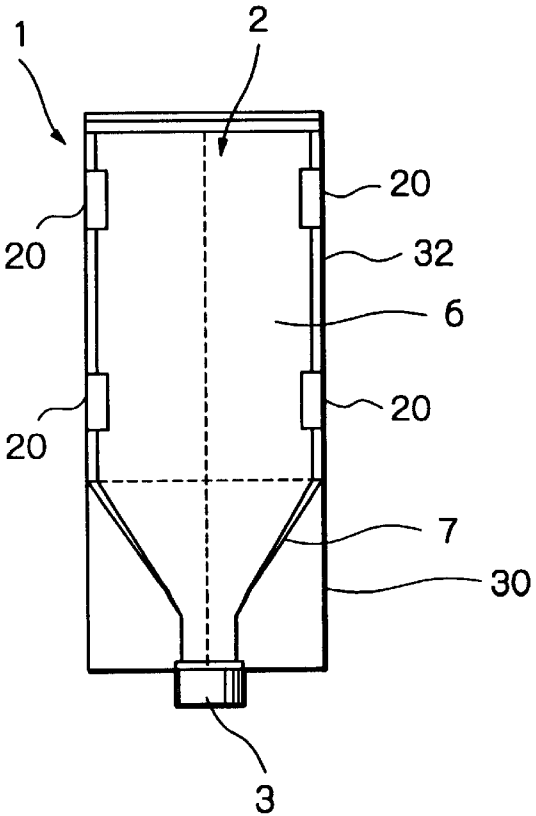
FIG. 5 is a view showing a modification of the powder container of FIG. 4.

Further, the anti-slip members 20 should preferably be positioned above, but close to, the tapered portion 7 of the bag 2. Assume that the toner container 1 is mounted to an image forming apparatus and has its toner consumed to a certain degree. Then, the anti-slip members 20 located at the above position where the toner is present effectively act against a shock or an impact that may act on the toner container 1. The anti-slip members 20 located at a position where the toner is absent are almost useless. The number of anti-slip members 20 is open to choice and may even be one. For example, four anti-slip members 20 may be fitted on the box 30, as shown in FIG. 5. The prerequisite with the configuration shown in FIG. 5 is that at least one anti-slip member 20 be so located as to bite into the body portion 6 in the vicinity of the tapered portion 7 of the bag 2.

Figure 6:
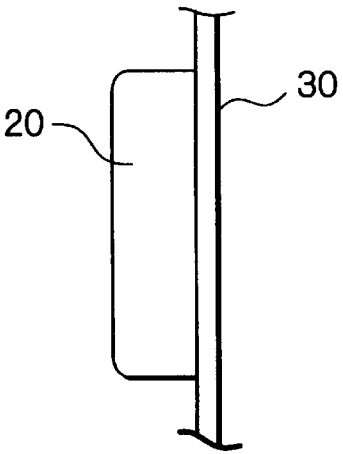
FIG. 6 is an enlarged view showing part of an anti-slip member.

A specific configuration of each anti-slip member 20 will be described hereinafter. The anti-slip member 20 is 4 mm thick, 10 mm wide and 90 mm long; the bag 2 is 112 mm wide. It was experimentally found that the thickness should preferably be 2 mm to 10 mm. The anti-slip member 20 is implemented by a flat plate-like member. In this case, however, the edges of the anti-slip member 20 are apt to scratch the bag 2 and cause it to break, resulting in the leakage of toner. To solve this problem, the edges of the anti-slip member 20 should be rounded, as shown in FIG. 6.

Moreover, the anti-slip members 20 are expected to prevent the body portion 6 of the bag 2 from being shifted toward the toner outlet 8 by a shock or an impact. It follows that the surface of each anti-slip member 20 to bite into the bag 2 should have a certain coefficient of friction. Experiments showed that the anti-slip members 20 successfully prevented the body portion 6 from being shifted when the coefficient of friction was 2.5 or above.

As shown in FIG. 1, the bag 2 has triangular folded portions 10 at its top, as indicated by hatching. The folded portions 10 are conventional with bags in general. The bag 2 is sealed by heat sealing along its edges indicating by hatching.

Figure 7:
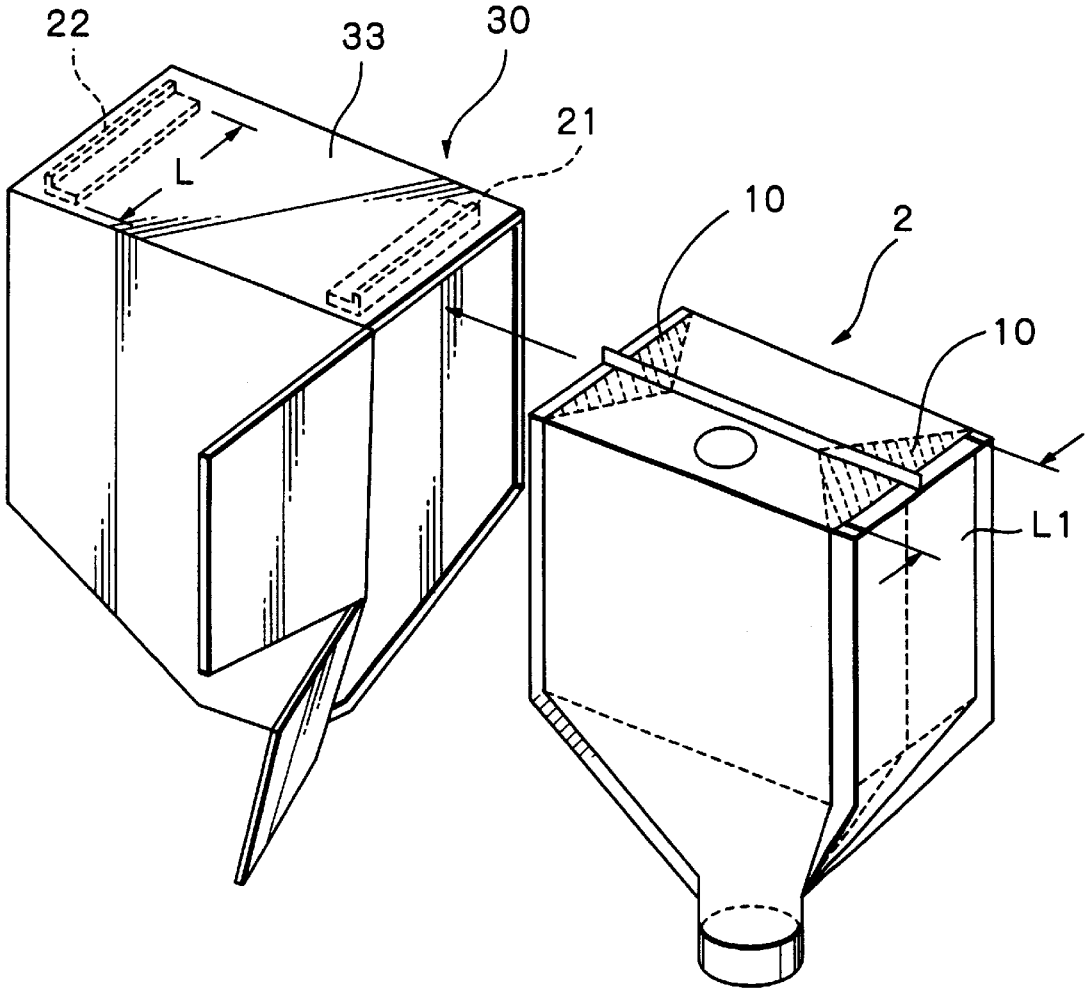
FIG. 7 is a perspective view showing an alternative embodiment of the toner container in accordance with the present invention.

FIG. 7 shows an alternative embodiment of the present invention including the buckle reducing means that effectively uses the folded portions 10 of he bag 2. As shown, the box 30 includes a top wall 33. Insertion members 21 and 22, constituting the buckle reducing means, are fitted on the inner surface of the top wall 33 at positions corresponding to the folded portions 10 of the bag 2. The insertion members 21 and 22 resemble hooks having a generally L-shaped cross-section. The insertion members 21 and 22 each have a length L slightly smaller than the length L1 of each folded portion 10. When the bag 2 is received in the box 30, the insertion members 21 and 22 are inserted in gaps 11 (see FIG. 8) formed by the folded portions 10 over substantially the entire length of the gaps. The insertion members 21 and 22 may be molded integrally with the top wall 33 of the box 30 or affixed to the top wall 33 by adhesive.

Figure 8:
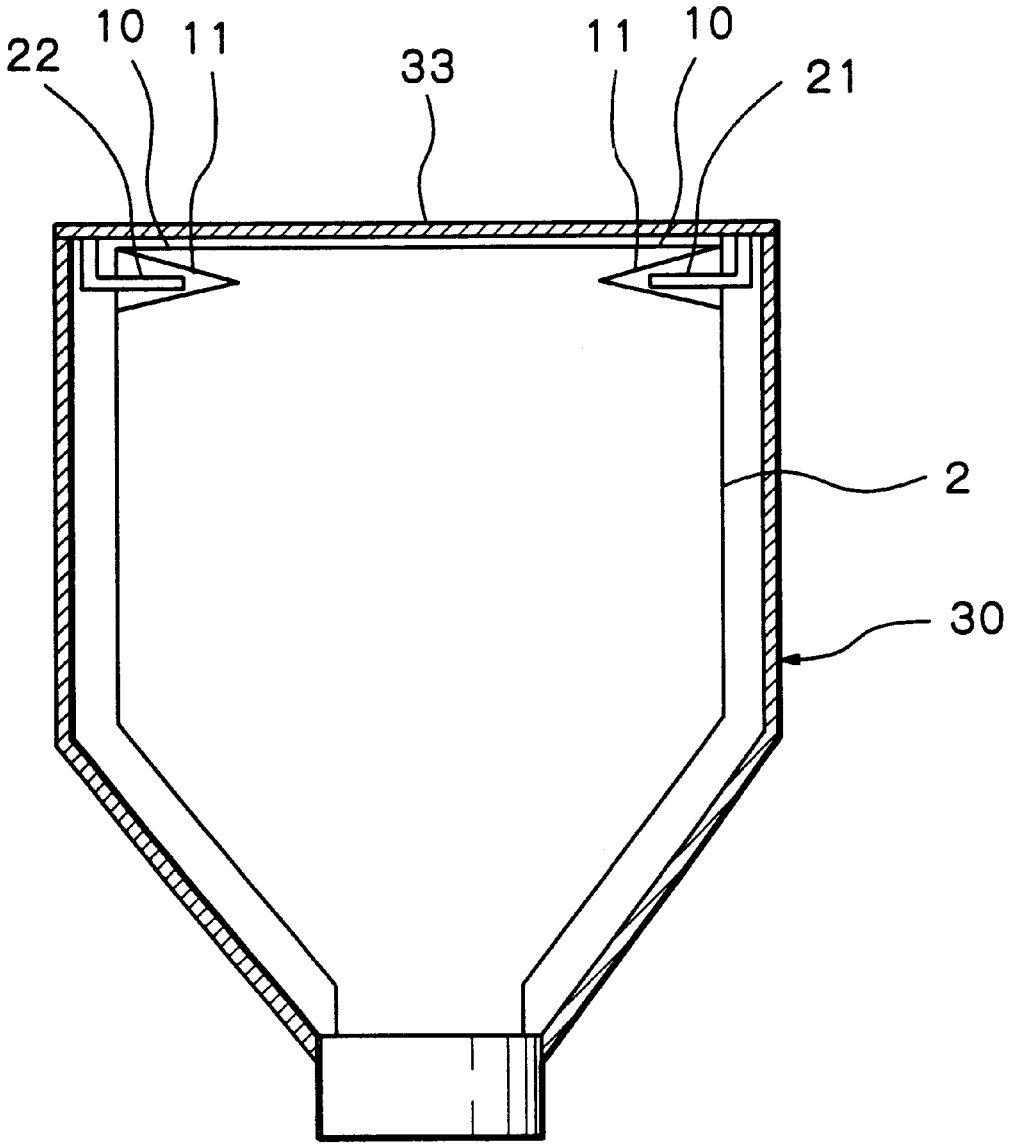
FIG. 8 is a section of the toner container shown in FIG. 7.

In the condition shown in FIG. 8, the bag 2 is substantially suspended from the box 30 via the insertion member 21 and 22 and therefore does not noticeably move even when subjected to a shock or an impact. This surely reduces the buckling of the bag 2 around the tapered portion 7 and toner outlet 8, as shown in FIG. 3. Further, the illustrative embodiment uses the folded portions 10 customary with bags and is therefore practicable at low cost without resorting to any special treatment of the bag 2. If desired, the insertion members 21 and 22 may be replaced with stubs or small L-shaped hooks positioned at opposite ends of the length L of the members 21 and 22.

Figure 9:
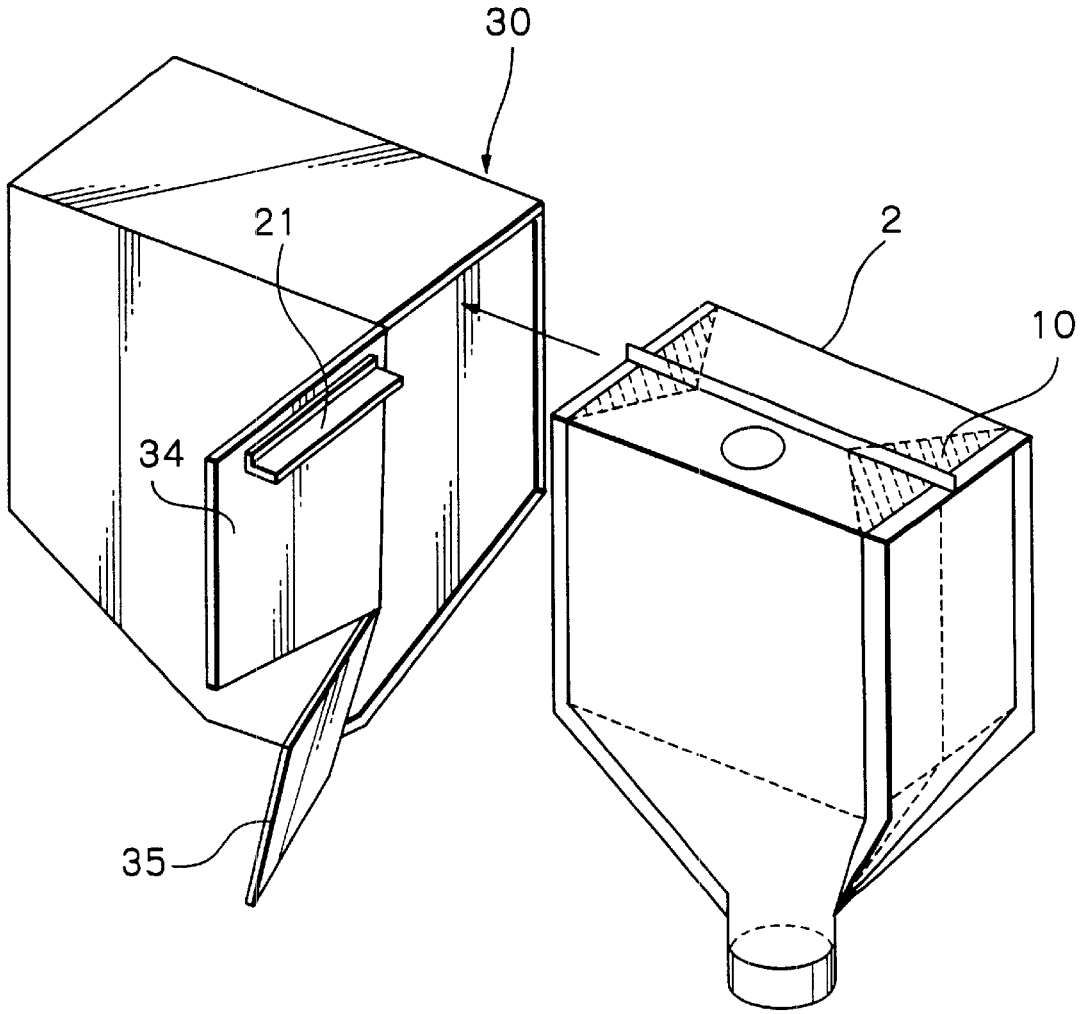
FIG. 9 is an isometric view showing a modification of the toner container of FIG. 7.

FIG. 9 shows another alternative embodiment of the present invention configured to facilitate the insertion of the insertion members 21 and 22 into the folded portions 10. As shown, one wall of the box 30 is implemented as two flaps 34 and 35 that are opened at the time of insertion of the bag 2 into the box 30. After the bag 2 has been inserted into the box 30, the flaps 34 and 35 are closed to complete the toner container 1. In the illustrative embodiment, the insertion member 21 is adhered or otherwise affixed to the flap 34. The insertion member 21 is therefore automatically, easily inserted into the gap of the folded portion 10 when the flap 34 is closed. Although the other insertion member 22 is absent in the illustrative embodiment, the insertion member 21 is capable of suspending the bag 2 and therefore sufficiently reducing the buckling of the bag 2.

Figure 10:
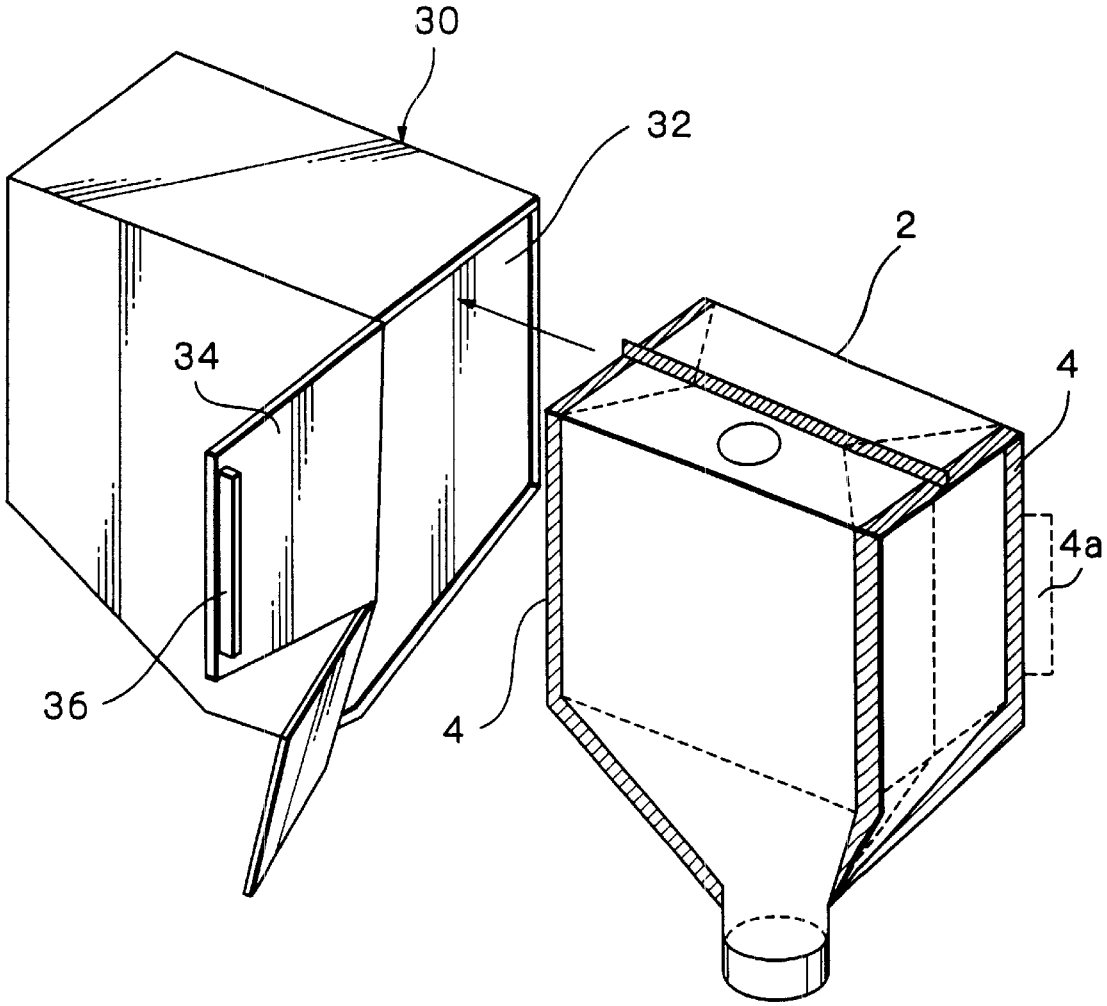
FIG. 10 is a perspective view showing another alternative embodiment of the toner container in accordance with the present invention.

FIG. 10 shows another alternative embodiment of the present invention similar to the embodiment of FIG. 9 except for the following. As shown, the illustrative embodiment uses heat-sealed portions 4 indicated by hatching in implementing the buckle reducing means. A nipping member 36 is adhered or otherwise provided on the free or outermost end of the flap 34. The nipping member 36 nips one heat-sealed portion 4 between it and the vertical wall 32 of the box 3 when the flap 34 is closed. The nipping member 36 therefore easily, surely reduces the buckling of the bag 2.

If desired, part 4*a* of the heat-sealed portion 4 to be retained by the nipping member 36 may be protruded, as indicated by a dotted line in FIG. 10. This further facilitates the nipping of the heat-sealed portion 4. The flap 34 itself may nip the heat-sealed portion 4 between it and the vertical wall 32, in which case the protruded portion 4*a* will help the flap 34 easily, surely nip the heat-sealed portion 4.

Figure 11:
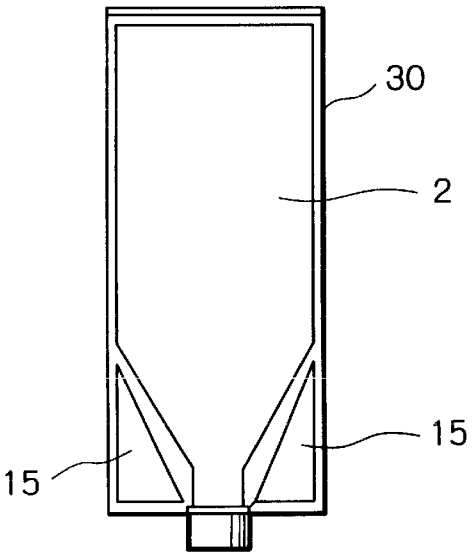
FIG. 11 is a view showing still another alternative embodiment of the toner container in accordance with the present invention.

FIG. 11 shows still another alternative embodiment of the present invention. As shown, in the illustrative embodiment, the buckle reducing means is implemented by shock absorbing pieces 15 formed of, e.g., styrofoam. The shock absorbing pieces 15 are so shaped as to substantially fill up the spaces A when the bag 2 is inserted into the box 30. The shock absorbing pieces 15 may be fitted after the insertion of the bag 2 into the box 30 or adhered to the box 30 beforehand in order to facilitate the work. In this configuration, even when a shock or an impact acts on the toner container 1, the buckling of the bag 2 can be surely reduced because no spaces are present below the bag 2.

Figure 12:
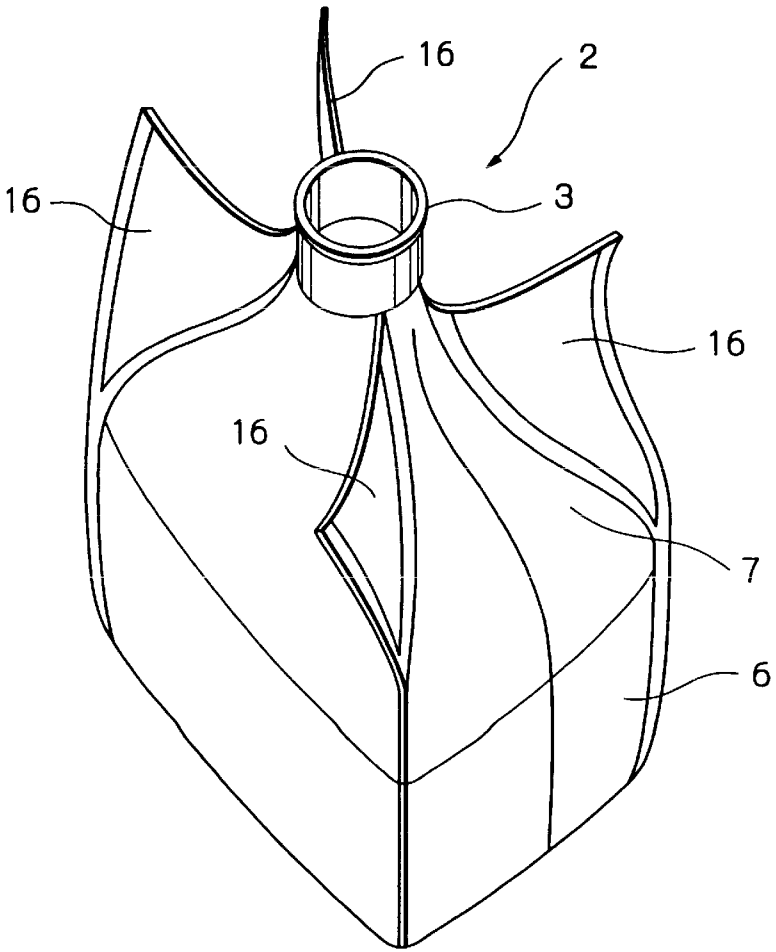
FIG. 12 is an isometric view showing a further alternative embodiment of the toner container in accordance with the present invention, as seen from the bottom.
Figure 13:
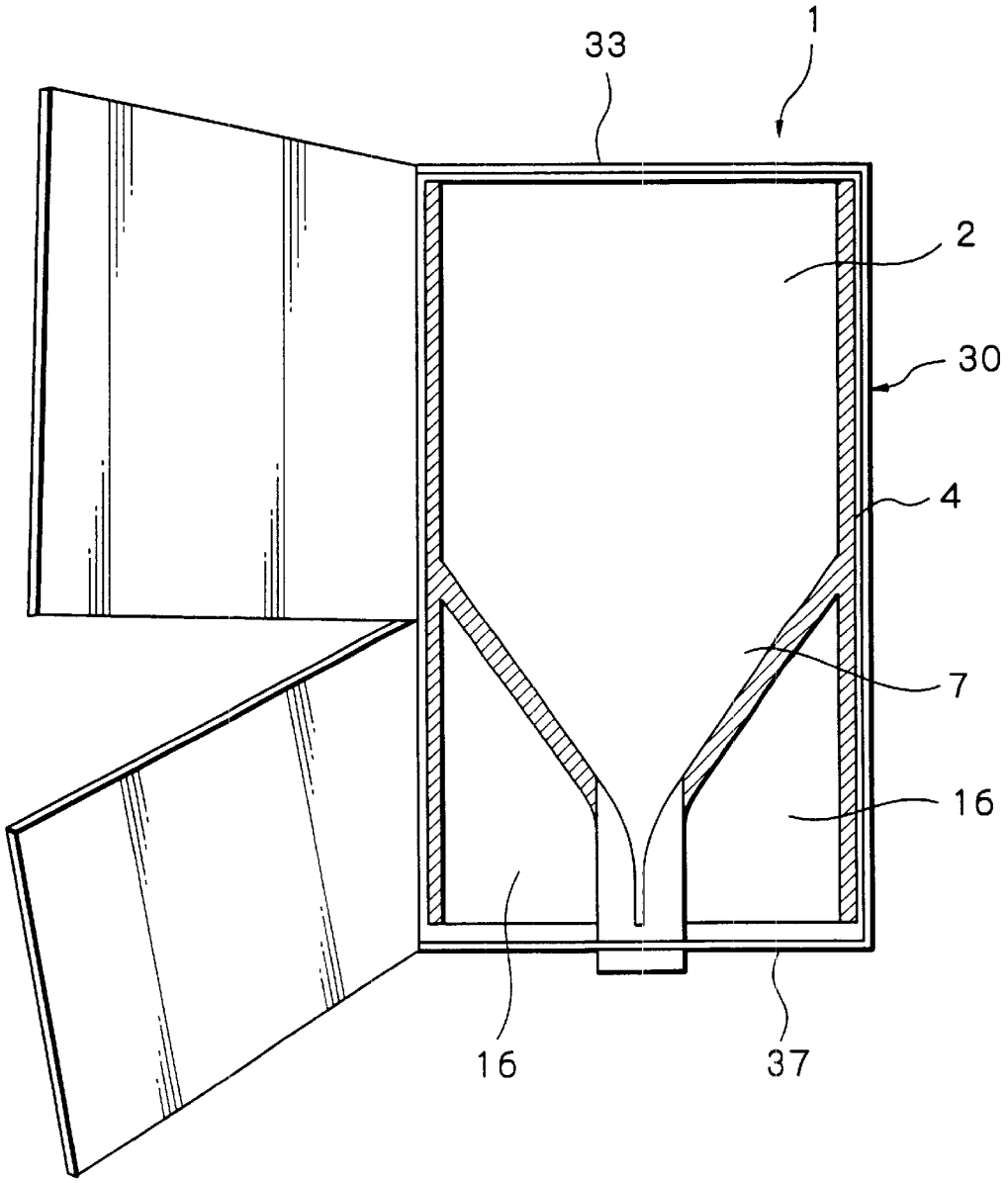
FIG. 13 is a view showing how the toner container of FIG. 12 is used.

Reference will be made to FIG. 12 for describing yet another alternative embodiment of the present invention. This embodiment differs from the foregoing embodiments in that the bag 2 itself includes the buckle reducing means. As shown, the bag 2 includes a plurality of legs or auxiliary pieces 16 extending out from the tapered portion 7. As shown in FIG. 13, each leg 16 is long enough to reach or adjoin the bottom wall 37 of the box 30 when the bag 2 is inserted into the box 30. Even when a shock or an impact acts on the toner container 1, the legs 16 successfully reduce the buckling of the bag 2. Moreover, because the legs 16 are formed integrally with the bag 2, the illustrative embodiment is applicable even to a toner container lacking the rigid box 30.

Figure 14:
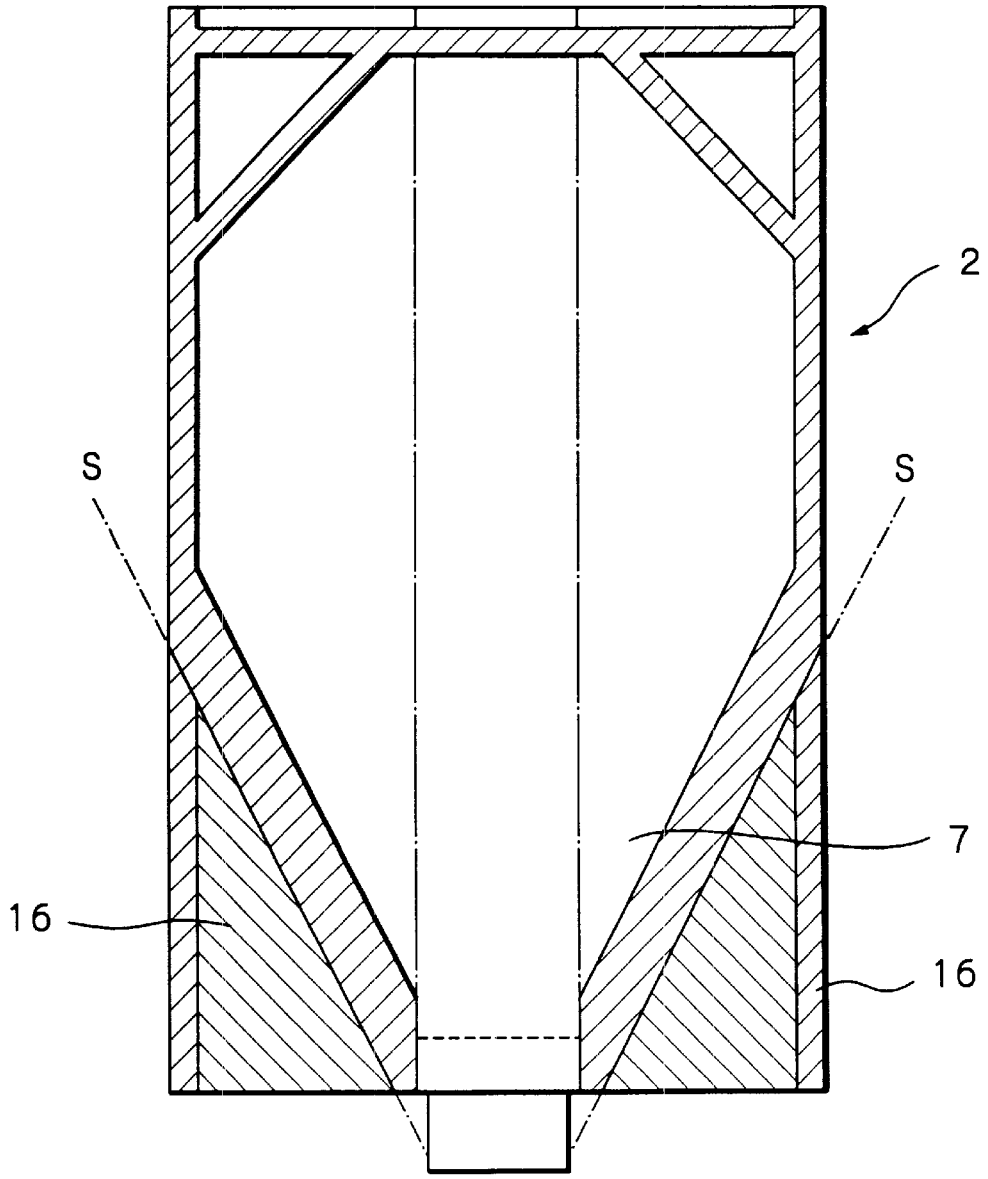
FIG. 14 is a view showing the toner container of FIG. 12 in a collapsed condition.

The legs 16 may be adhered or otherwise affixed to the bag 2. However, forming the legs 16 integrally with the bag 2 is advantageous not only from the cost standpoint, but also from the mechanical strength standpoint. In the illustrative embodiment, the bag 2 is constituted by four films that are connected together at the heat-sealed portions 4. Again, the bag 2 includes the tapered portion 7 and toner outlet 8. FIG. 14 shows the bag 2 formed. As shown, excess pieces contiguous with the tapered portion 7 are formed during production. While the conventional bag 2 shown in FIG. 1 cuts away the excess pieces along lines S, the illustrative embodiment does not cut the excess pieces, but uses them as the legs 16.

The above configuration allows the legs 16 to be easily formed and reduces the cost to a noticeable degree. In FIG. 14, the portions of the legs 16 indicated by reverse hatching are usually not subjected to heat sealing. Such portions of the legs 16 may also be subjected to heat sealing in order to increase the mechanical strength of the legs 16.

Figure 15:
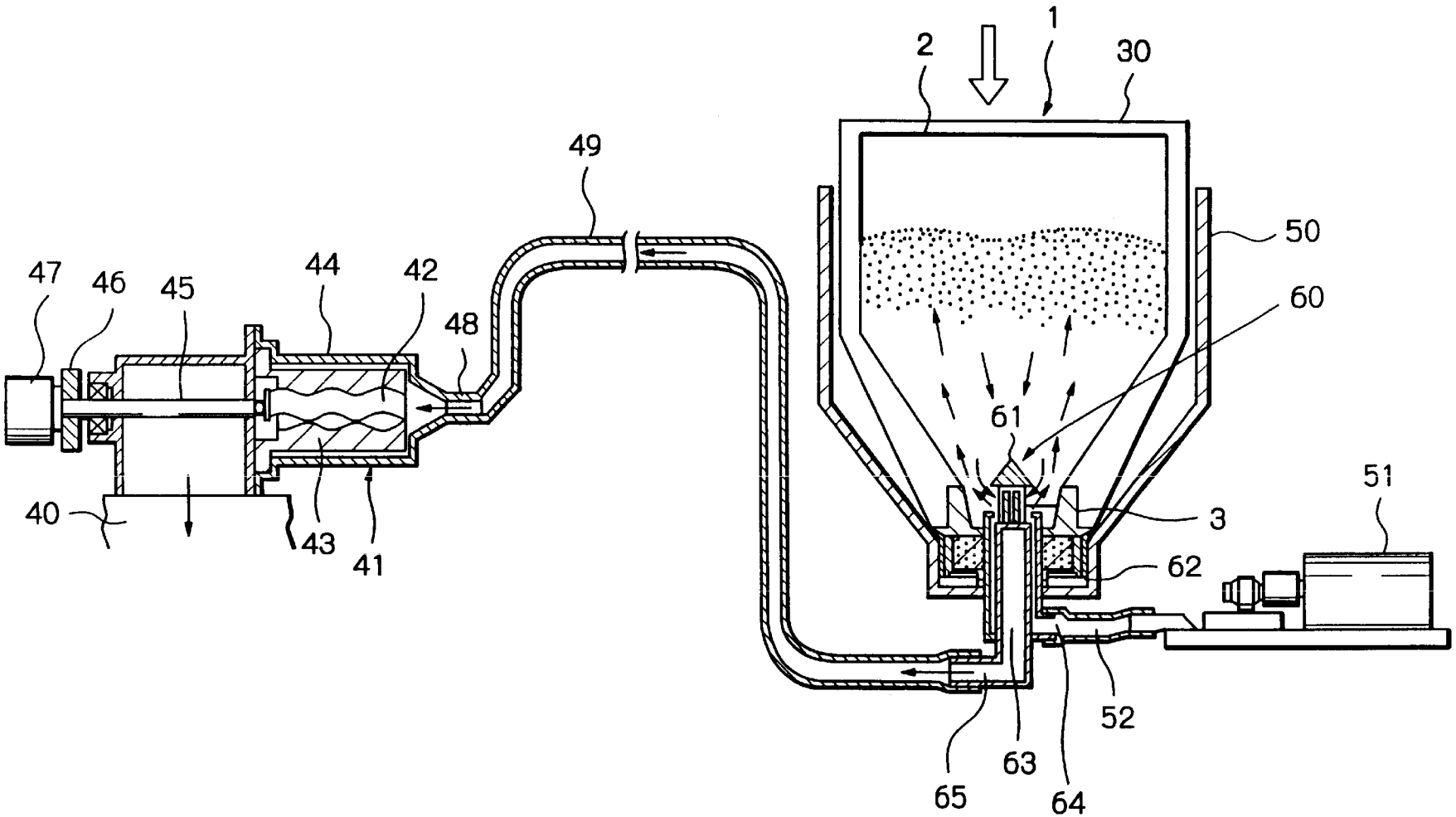
FIG. 15 is a view showing a specific toner replenishing device using a toner container of the present invention.

FIG. 15 shows a specific toner replenishing device included in an image forming apparatus, which incorporates the toner container 1 of the present invention. As shown, a suction type powder pump 41 adjoins or is constructed integrally with a developing unit 40. The powder pump 41 is a single shaft, eccentric screw pump. Specifically, the powder pump 41 generally made up of a rotor 42, a stator 43, and a holder 44. The rotor 42 is formed of metal or similar rigid material and implemented as an eccentric screw. The stator 43 is formed of rubber or similar elastic material and provided with a double screw configuration. The holder 44 accommodates the rotor 42 and stator 43 and forms a powder conveyance path. The holder 44 is formed of, e.g., resin. The rotor 42 is caused to rotate via a gear 46 connected to a drive shaft 45. A solenoid-operated clutch 47 controls the operation of the powder pump 41.

The holder 44 has a toner suction port 48 at its right end, as viewed in FIG. 15. A tube 49 provides fluid communication between the toner suction port 48 and a toner outlet port 65 formed in a nozzle 60, which will be described specifically later. The tube 49 should preferably be implemented by a flexible tube having a diameter of 4 mm to 10 mm and formed of rubber highly resistant to toner, e.g., polyurethane rubber, nitryl rubber, EPDM or silicon rubber. The flexible tube 49 can be easily laid in any desired direction, i.e., upward, downward, leftward or rightward.

The powder pump 41 having the above configuration is capable of continuously conveying powder with a high solid-to-gas ratio by an amount accurately proportional to the rotation speed of the rotor 42, as well known in the art. When a toner replenishment command is generated on the basis of, e.g., the output of an image density sensor, the powder pump 41 is energized to replenish a required amount of toner to the developing unit 40.

The toner container 1 is removably mounted to a mounting unit 50 included in the body of the image forming apparatus and separate from the developing unit 40. The previously mentioned nozzle 60 protrudes upward from the mounting unit 50 in such a manner as to penetrate into the bag 2 of the toner container 1. The toner container 1 is mounted to the mounting portion 50 from above the apparatus body. The mounting unit 50 has a conical tip member 61 adhered thereto or integrally molded therewith. An air feed passage 62 and a toner delivery passage 63 are contiguous with the tip member 61, as illustrated. The nozzle 60 has a double tube structure. The toner delivery passage 63 is bent to the left, as viewed in FIG. 15, and terminates at the toner delivery port 65. The air feed passage 62 is bent to the right, as viewed in FIG. 15, at a higher level or height than the toner delivery port 63 and terminates at an air inlet port. A self-closing valve, not shown, formed of sponge or similar material is fitted in the mouth member 3 of the toner container 1.

A pipe 52 provides fluid communication between the air inlet port 64 and an air pump or air feeding means 51. The air pump 51 feeds air under pressure to the toner container 1 via the pipe 52 and air passage 62. Air sent into the toner container 1 passes through the toner layer and fluidizes it by scattering it. More specifically, the above air increases pressure inside the bag 2 with the result that the toner is discharged from the toner container 1 while being sufficiently agitated and fluidized. At this instant, the powder pump 41 helps air deliver the toner and surely replenishes the toner to the developing unit 40.

If desired, the buckle reducing means may be implemented by a combination of two or more of the anti-slip members, insertion member, shock absorbing members and legs, or auxiliary members, shown and described. While the illustrative embodiments have concentrated on toner, they are similarly applicable to a toner and carrier mixture or a carrier only.

The embodiments shown and described have various unprecedented advantages, as enumerated below.

(1) Even a flexible bag having a tapered outlet portion causes the outlet portion to buckle little.

(2) The bag itself includes buckle reducing means. This reduces the buckling of a powder container consisting only of a bag. When leg-like auxiliary pieces are implemented by excess formed during the production of the bag, the bag achieves an adequate degree of strength at low cost.

(3) The buckle reducing means reduces the buckling of the back even when provided on a box accommodating the bag.

(4) There can be provided an image forming apparatus using the powder container as a toner container.

Other preferred embodiments of the present invention directed toward the second object will be described hereinafter.

Figure 16:
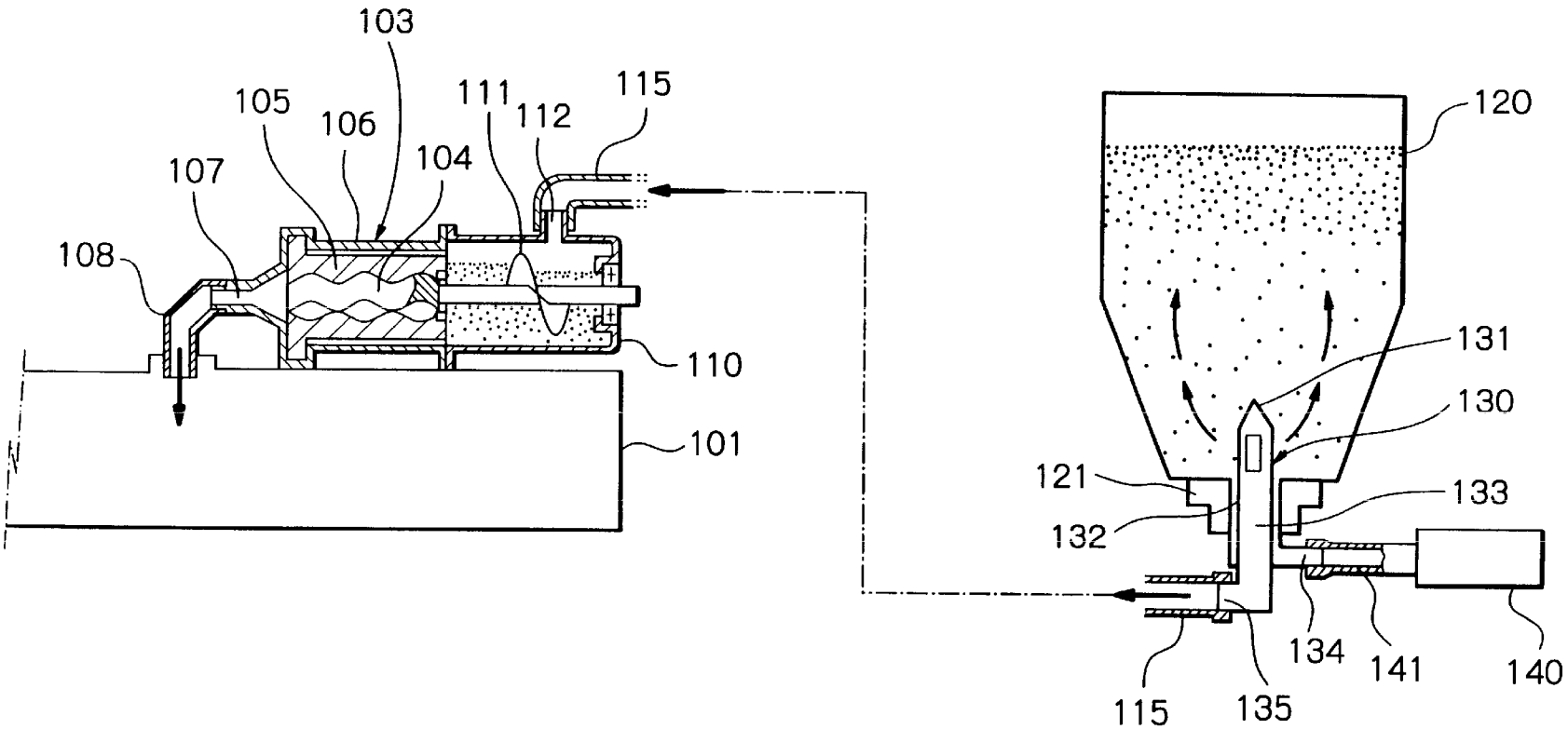
FIG. 16 is a view showing another specific toner replenishing device using a toner container of the present invention.

Referring to FIG. 16, a toner replenishing device is shown to which the embodiments of the toner container to be described later are applicable. There are shown in FIG. 16 a developing unit 101 and a toner container 120 storing color toner. The toner container 120 is a unit separate from the developing unit 101 and removably mounted to a mounting portion included in the body of an image forming apparatus. The mounting portion may be so arranged as to be accessible when a door or a cover mounted on the apparatus body is opened, although not shown specifically. Alternatively, the mounting portion maybe exposed to the outside of the apparatus body.

Figure 18:
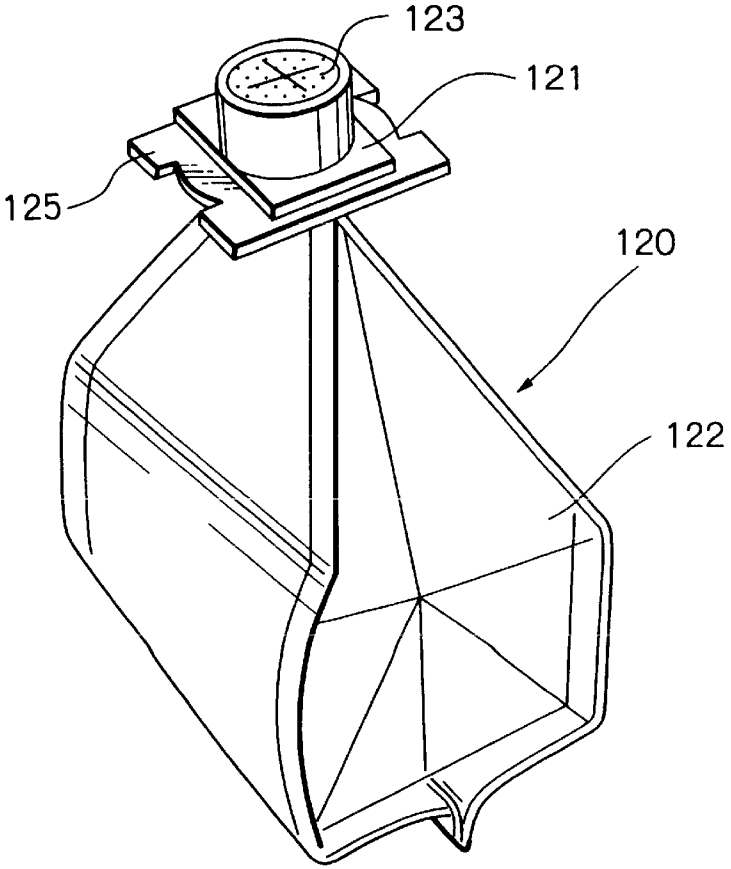
FIG. 18 is a perspective view of the toner container, as seen from the bottom.
Figure 17:
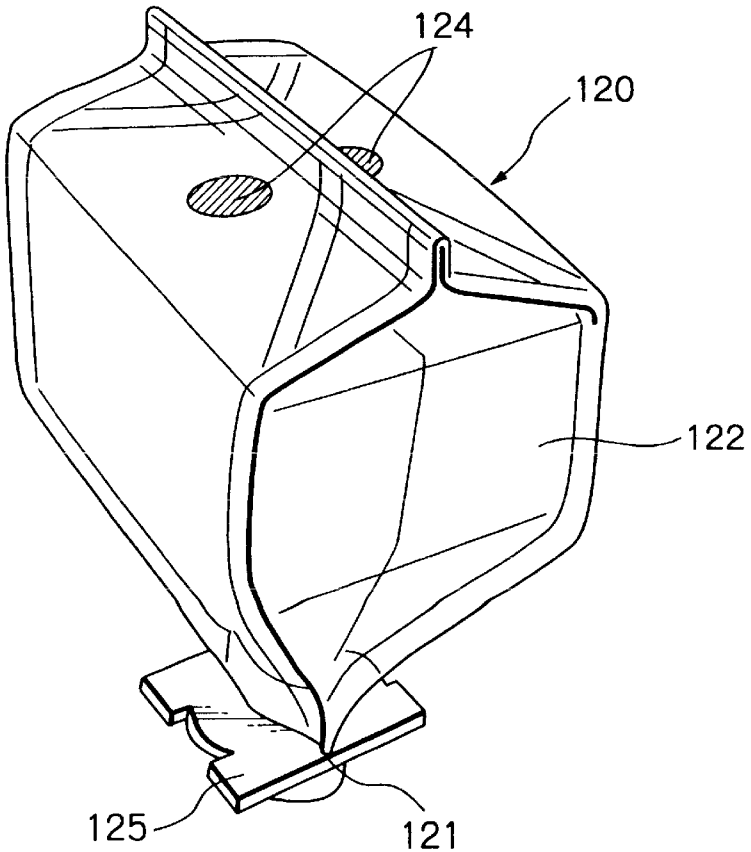
FIG. 17 is a perspective view of the toner container, as seen from the top.

FIGS. 17 and 18 show the toner container 120. As shown, the toner container 120 includes a mouth portion 121 formed of, e.g., resin and produced by blow molding or similar scheme. A toner outlet is formed in the mouth portion 121. A bag 122 is affixed to the mouth portion 121 and implemented by a single flexible sheet of, e.g., polyethylene, Nylon or similar resin or paper or a laminate of such sheets. Each sheet is about 80 $\mu$m to 200 $\mu$m thick byway of example. The toner container 120 is hermetically sealed and has the mouth portion 121 at its bottom. A self-closing seal valve 123 is fitted in the mouth portion 121 and formed of foam sponge or similar elastic member. Aluminum may advantageously be deposited on the inner periphery or the outer periphery of the bag 12 against static electricity and moisture.

The bag 122 has a substantially rectangular shape when inflated and includes one surface tapered toward the mouth portion 121. A filter member 124 is fitted on the top of the bag 122 and plays the role of pressure adjusting means. Specifically, the filter member 124 passes air therethrough, but blocks the toner.

Because the bag 122 is flexible, the toner container 120 is easier to handle than a hard case and needs a minimum of space. Generally, the toner container 120 is delivered from the user's station to a manufacturer when emptied and then recycled, reused or burned up. In this respect, the toner container 120, which is flexible and foldable, is easy to transport and store while occupying a minimum of space. This successfully reduces the collection cost to a considerable degree. The mouth portion 121, bag 122 and seal valve 123 should preferably be formed of the same material or similar materials in order to save time and labor for separation at a recycling cite.

The toner container 120 is removably mounted to a mounting position defined in the apparatus body from the above. As shown in FIG. 16, a nozzle 130 protrudes upward from the mounting position in such a manner as to penetrate into the seal valve 123. The nozzle has a conical tip member 131 adhered thereto or integrally molded therewith. An air feed passage 132 and a toner delivery passage 133 are contiguous with the tip member 131, as illustrated. The nozzle 130 has a double tube structure. The toner delivery passage 133 is bent to the left, as viewed in FIG. 16, and terminates at the toner delivery port 135. The air feed passage 132 is bent to the right, as viewed in FIG. 16, at a higher level or height than the toner delivery port 133 and terminates at an air inlet port 134.

In the illustrative embodiment, a pipe 141 provides fluid communication between the air inlet port 134 and an air pump or air feeding means 140. The air pump 140 feeds air under pressure to the toner container 120 via the pipe 141 and air passage 132. Air sent into the toner container 120 passes through the toner layer and fluidizes it by scattering it.

A suction type powder pump 103 adjoins or is constructed integrally with the developing unit 101. The powder pump 103 is a single shaft, eccentric screw pump. Specifically, the powder pump 103 is generally made up of a rotor 104, a stator 105, and a holder 106. The rotor 104 is formed of metal or similar rigid material and implemented as an eccentric screw. The stator 105 is formed of rubber or similar elastic material and provided with a double screw configuration. The holder 106 accommodates the rotor 104 and stator 105 and forms a powder conveyance path. The holder 106 is formed of, e.g., resin. The holder 106 has at its left end, as viewed in FIG. 16, a toner outlet port 107 communicated to the toner replenishing portion 102 of the developing unit 101 by a pipe 108.

The suction side of the powder pump 103 merges into a buffer or toner storing means 110 that stores an adequate amount of toner. A screw or toner driving means 111 is disposed in the buffer 110. One end of the screw 111 protrudes to the outside of the buffer 110 and is connected to a driveline, not shown, to be driven thereby. The other end of the screw 111 is connected to the rotor 104, so that the screw 111 is operated at the same time as the powder pump 103.

A toner inlet 112 is formed in the buffer 110 and communicated to the toner outlet 135 of the nozzle 130 by a tube 115. The tube 115 should preferably be implemented by a flexible tube having a diameter of 4 mm to 10 mm and formed of rubber highly resistant to toner, e.g., polyurethane rubber, nitryl rubber, EPDM or silicon rubber. The flexible tube 115 can be easily laid in any desired direction, i.e., upward, downward, leftward or rightward.

The powder bump 103 having the above configuration is capable of continuously conveying powder with a high solid-to-gas ratio by an amount accurately proportional to the rotation speed of the rotor 104, as well known in the art. When a toner replenishment command is generated on the basis of, e.g., the output of an image density sensor, the powder pump 103 is energized to replenish a required amount of toner to the developing unit 101.

In the toner container 120, the surface of the bag 122 extending toward the bottom is inclined. This, coupled with the fact that the toner container 120 is used in an upright position, is likely to cause the bag 122 to tilt or collapse. The resulting creases of the bag 122, for example, obstruct the drop of the toner to the seal valve 123 and thereby prevent the toner from being fully discharged from the bag 122. Further, edges or similar sharp portions are apt to break the bag 122 if present around the toner container 120 set on the apparatus body.

In light of the above, the present invention additionally includes position maintaining means for maintaining the bag 122 of the toner container 120 in substantially an upright position. Preferred embodiments of the present invention including the position maintaining means will be described hereinafter.

Figure 19:
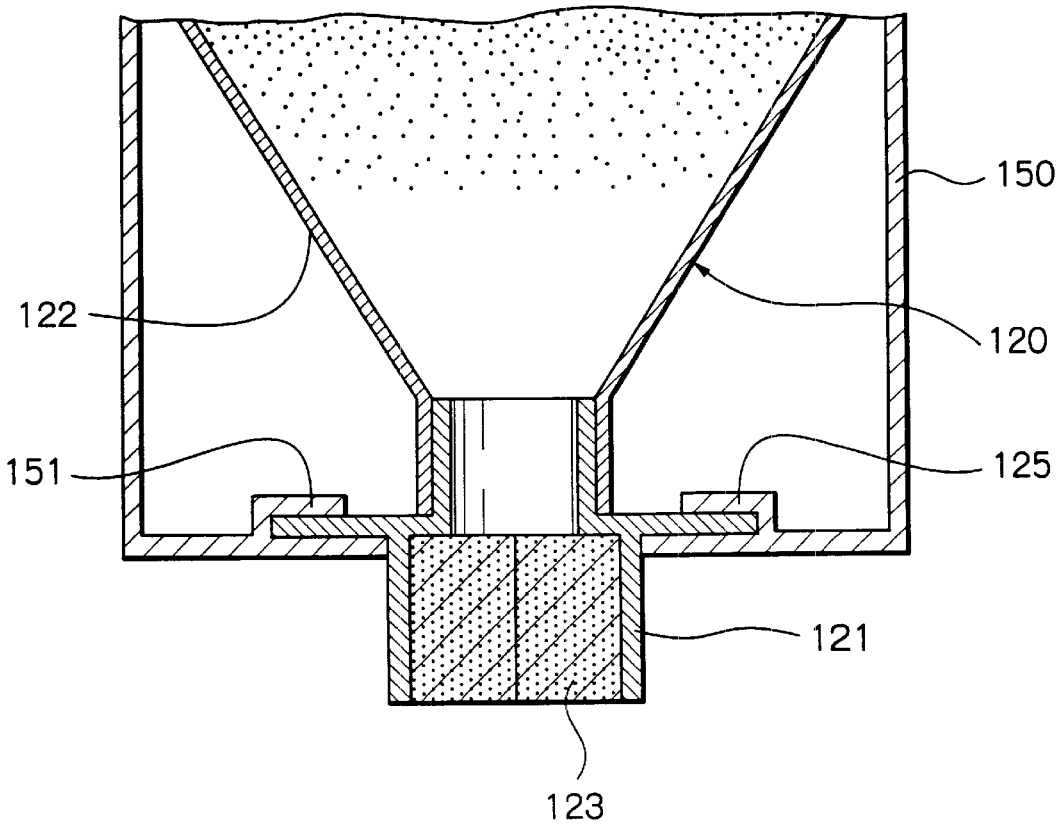
FIG. 19 is a fragmentary section showing an embodiment of the toner container in accordance with the present invention.
Figure 20:
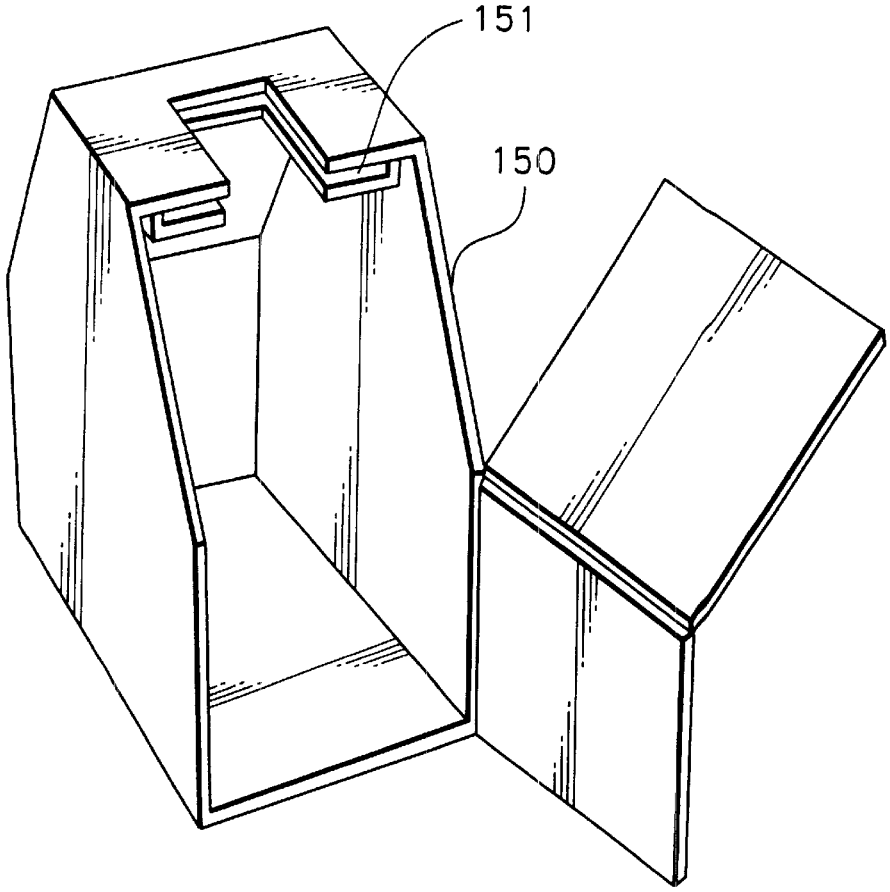
FIG. 20 is a perspective view showing a box accommodating the toner container of FIG. 19.

FIG. 19 shows an embodiment of the toner container in accordance with the present invention. As shown, the toner container 120 is accommodated in a box 150, which plays the role of the position maintaining means, in a bag-in-box fashion. As shown in FIG. 20, the box 150 has a space there inside that is so sized as to be substantially fully occupied by the inflated toner container 120. The box 150 may be formed of resin or paper having a certain degree of rigidity.

The box 150 protects the toner container 120 accommodated therein and therefore maintains the bag 122 in substantially an upright position. This causes a minimum of toner to be left in the bag 122 and protects the bag 122 from damage ascribable to tips and sharp edges. Further, the box 150 allows the toner container 120 to be easily mounted and dismounted from the apparatus body. In addition, such boxes 150 identical in configuration can be neatly stored. As shown in FIG. 19, a guide piece 125 may protrude from the mouth portion 121 of the toner container 120. The guide piece 125 is removably inserted into a portion 151 protruding from the box 150. This allows the toner container 120 to be easily separated from the box 150 and collected alone at the time of collection. The illustrative embodiment therefore preserves the low collection cost particular to a flexible container.

Figure 21:
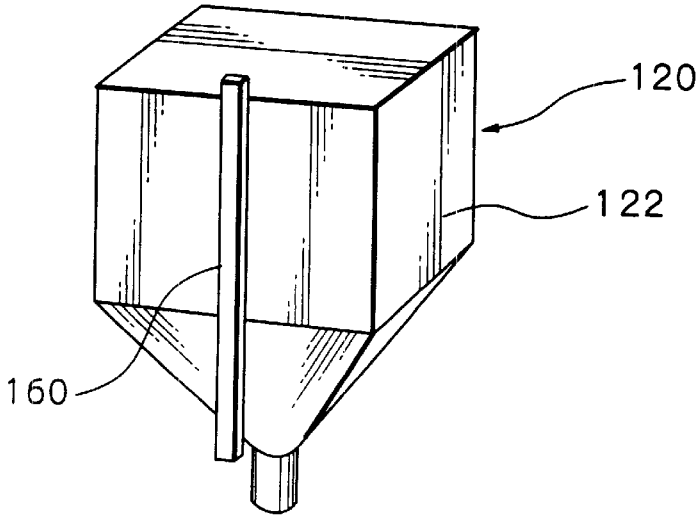
FIG. 21 is an isometric view showing an alternative embodiment of the toner container in accordance with the present invention.

FIG. 21 shows an alternative embodiment of the present invention. As shown, the position maintaining means is implemented by a rod- or bar-like support member 160 provided on the toner container 120 for supporting the container 120. The support member 160 may be located at the container mounting position or may be fitted on the mouth portion 121 in an upright position. If desired, the end of the support member 160 may be implemented as a grip in order to facilitate the handling of the toner container 120.

Figure 22:
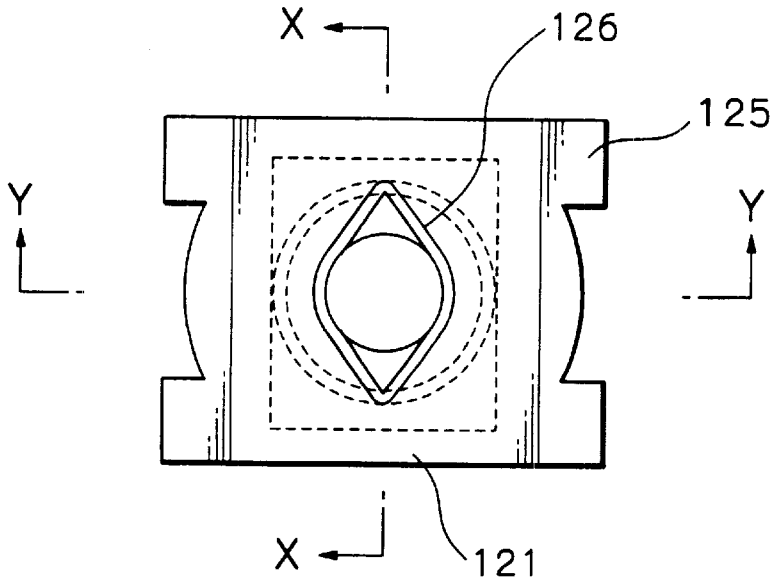
FIG. 22 is a front view of a mouth portion included in any one of the embodiments of the present invention.
Figure 23:
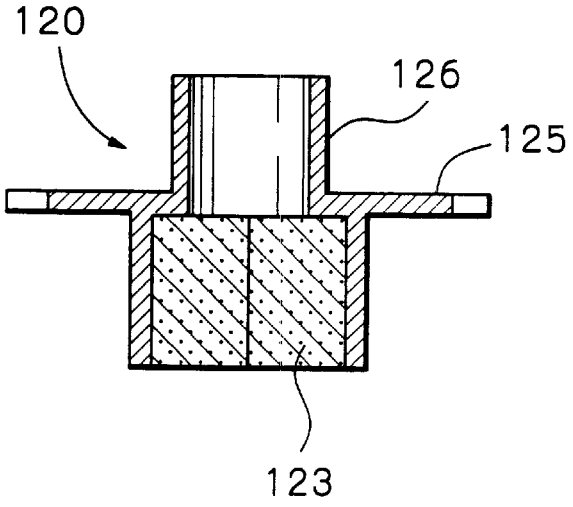
FIG. 23 is a section along line X—X of FIG. 22.
Figure 24:
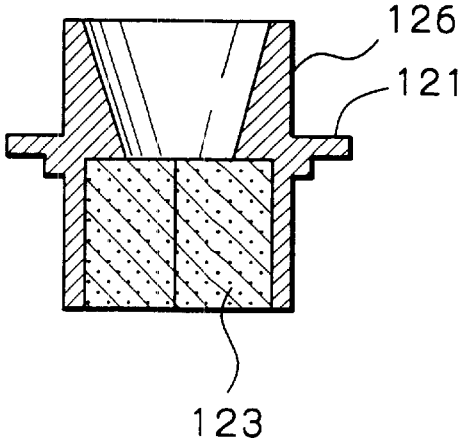
FIG. 24 is a section along line Y—Y of FIG. 22.

The direction in which the bag 122 falls down is determined by the configuration of the mouth portion 121. Specifically, as shown in FIGS. 22 through 24, part of the mouth portion 121 where the bag 122 is fitted has a boat-like configuration, so that the bag 122 falls down to either side in the widthwise direction of the boat. Therefore, the support member 160 should only be located at opposite sides in the widthwise direction (only one is visible).

Figure 25:
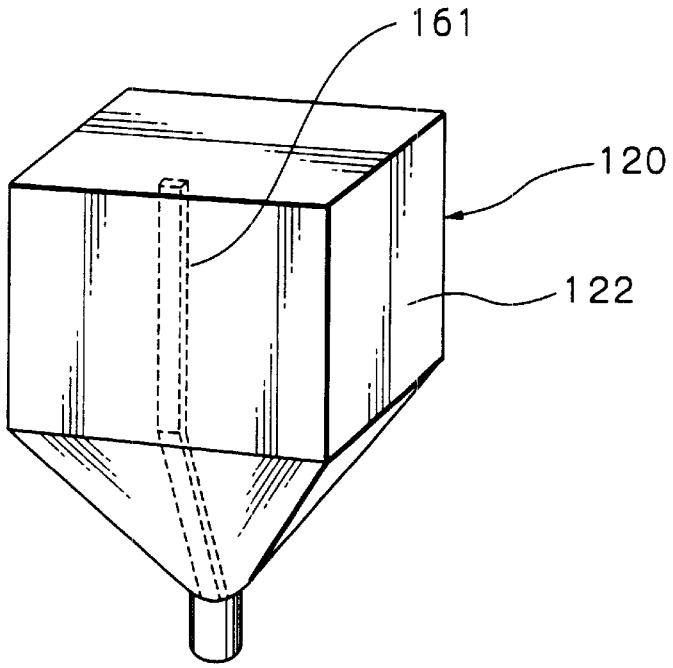
FIG. 25 is an isometric view showing a modification of the embodiment shown in FIG. 21.

A modification of the configuration of FIG. 21 is shown in FIG. 25. As shown, a support member or position maintaining means 161 is fitted on the inner periphery of the bag 122. Again, such a support member 161 is located at opposite sides in the widthwise direction of the boat-like part of the mouth portion 121.

Figure 26:
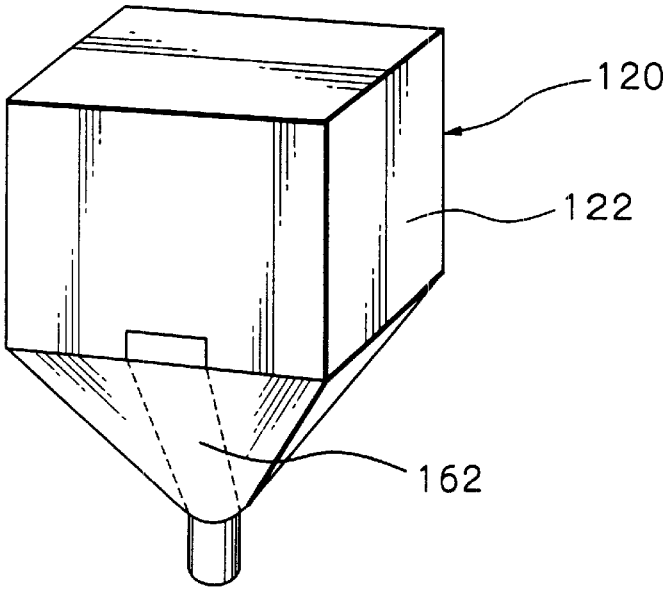
FIG. 26 is an isometric view showing another alternative embodiment of the toner container in accordance with the present invention.

FIG. 26 shows an alternative embodiment of the present invention in which the position maintaining means is implemented by a reinforcing member 162. As shown, the reinforcing member 162 is affixed to the mouth member 121 at one end thereof and is adhered to the relatively lower portion of the side of the bag 122 that is apt to fall down. The reinforcing member 162 is shaped complementarily to the contour of the bag 122 beforehand and should preferably be implemented by a film of Mylar or similar resin.

Figure 27:
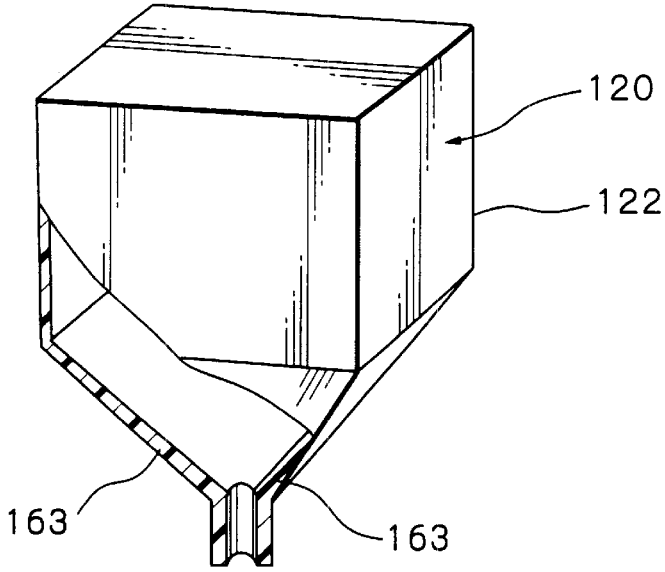
FIG. 27 is a partly sectional isometric view showing a modification of the embodiment of FIG. 26.

FIG. 27 shows a modification of the configuration of FIG. 26. As shown, the bag 122 has its wall portions substantially corresponding to the reinforcing members 162 increased in thickness. Such a configuration not only maintains the upright position of the bag 122, but also omits an adhering step while obviating the come-off of the reinforcing members 162 and other troubles ascribable to adhesion.

Figure 28:
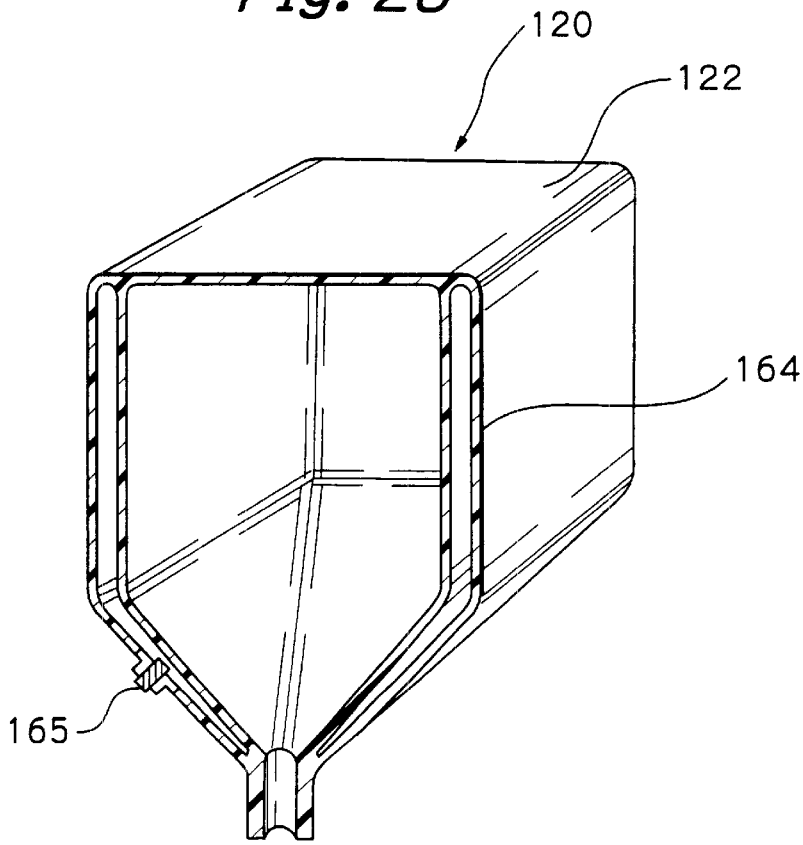
FIG. 28 is a sectional perspective view showing another alternative embodiment of the toner container in accordance with the present invention.

FIG. 28 shows still another alternative embodiment of the present invention. As shown, the bag 122 has a generally double-wall structure. Specifically, the bag 122 has a hermetically closed reinforcing bag 164 extending from the sides of the body portion of the bag 122 to the tapered inclined surfaces. A charging member 165 is fitted in the reinforcing bag 164. The reinforcing bas 164 is filled with a gas or a liquid via the charging member 165 so as to play the role of the position maintaining means.

Figure 29:
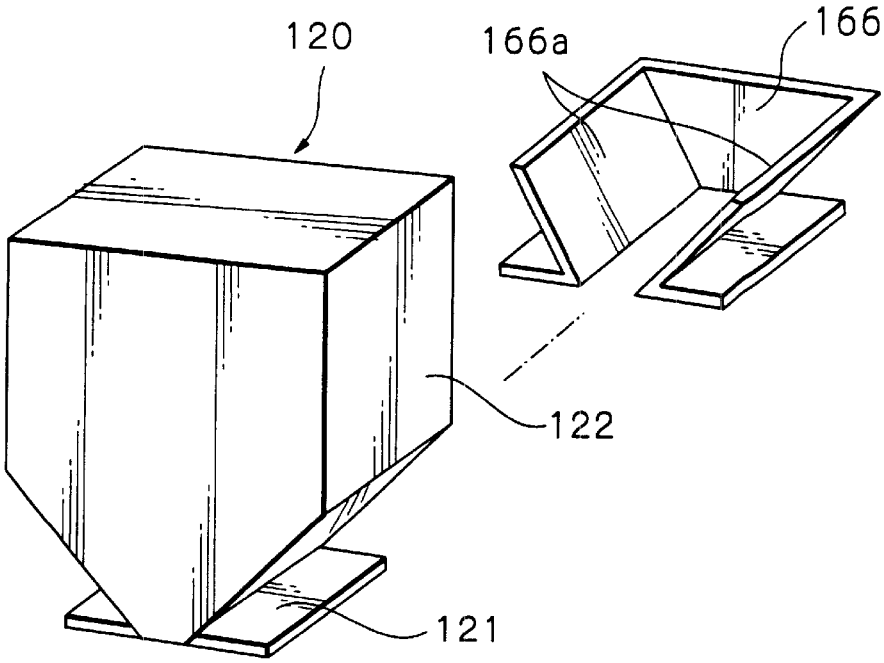
FIG. 29 is an isometric view showing yet another embodiment of the toner container in accordance with the present invention.

FIG. 29 shows yet another alternative embodiment of the present invention. As shown, a removable support member or position maintaining means 166 is engaged with the mouth portion 121 of the toner container 120. The support member 166 has support walls 166*a* in the direction in which the bag 122 falls down. It is noteworthy that the support member 166 can be mounted to the toner container 120 at the time when the container 120 is mounted to the apparatus body. The toner container 120 will therefore be collected alone when it is emptied.

Figure 30:
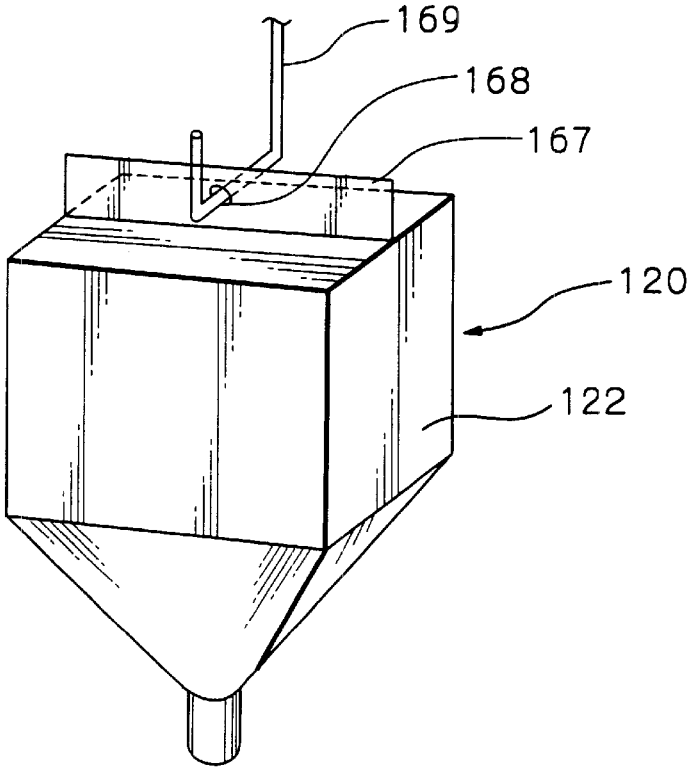
FIG. 30 is an isometric view showing a further alternative embodiment of the toner container in accordance with the present invention.

FIG. 30 shows a further alternative embodiment of the present invention. As shown, an upright piece 167 is affixed to or formed integrally with the top of the bag 122 and formed with a hole 168. A hook 169, which is included in the apparatus body, is received in the hole 168 so as to support the toner container 120 in a suspending fashion. This suspending configuration constitutes the position maintaining means. In the illustrative embodiment, the hook 169 does not have to constantly support the toner container 120, but should only support the container 120 when it is about fall down. For this reason, the toner container 120 is supported by the mounting portion of the apparatus body at the initial stage of use.

Any one of the position maintaining means described above causes the toner container 120, which is flexible and tapered, to fall down little and therefore causes a minimum of toner to be left in the container 120.

Air fed under pressure from the air pump 140 to the bag 122 makes substantial contribution to the function of maintaining the position of the bag 122. This air therefore constitutes part of the position maintaining means. The amount of air that can be fed to the toner container 120 is limited by the volume of the container 120. However, the filter member 124 included in the toner container 120 allows air to be fed without regard to the capacity of the container 120. That is, air can be fed to the toner container 120 in an amount great enough to fluidize the toner at all times while maintaining the bag 122 in an upright position. The powder pump 103 can smoothly suck the sufficiently fluidized toner, reducing the amount of toner to remain in the toner container 120. Air may be constantly fed to the toner container 120 in an amount that prevents the bag 122 from falling down.

In summary, the embodiments shown and described in relation to the second object of the present invention achieve various unprecedented advantages, as enumerated blow.

(1) The bag of a toner container is prevented from falling down in a set position despite that it is flexible. This prevents much toner from being left in the bag and prevents the bag from breaking due to fall-down.

(2) Position maintaining means may be implemented by both of the rigidity of a member and compressed air in order to prevent the bag from falling down more positively.

(3) Pressure inside the toner container is adjustable. This allows a great amount of air to be fed to the toner container for sufficiently agitating toner.

Various modifications will become possible for those skilled in the art after receiving the teachings of the present disclosure without departing from the scope thereof.

What is claimed is:

1. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means is provided on said bag, and said buckling reducing means comprises leg-like auxiliary pieces integral with said tapered portion.

2. A powder container as claimed in claim 1, wherein said auxiliary pieces comprise excess pieces formed during production of said bag.

3. A powder container as claimed in claim 2, wherein said auxiliary pieces are heat-sealed over entire range of said auxiliary pieces.

4. A powder container as claimed in claim 3, wherein said bag is received in a box that is more rigid than said bag.

5. A powder container as claimed in claim 1, wherein said bag stores the powder.

6. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means is provided on said bag, wherein said buckling reducing means comprises leg-like auxiliary pieces integral with said tapered portion, said auxiliary pieces comprise excess pieces formed during production of said bag, said auxiliary pieces are heat-sealed over entire range of said auxiliary pieces, said bag is received in a box that is more rigid than said bag, and said buckling reducing means additionally is provided on said box.

7. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means is provided on said bag, said buckling reducing means comprises leg-like auxiliary pieces integral with said tapered portion, said auxiliary pieces comprise excess pieces formed during production of said bag, said auxiliary pieces are heat-sealed over entire range of said auxiliary pieces, said bag is received in a box that is more rigid than said bag, and said buckling reducing means additionally comprises anti-slip members positioned on surfaces of said box, which face said bag, in such a manner as to contact said bag.

8. A powder container as claimed in claim 7, wherein said anti-slip members comprise ribs extending in a direction perpendicular to a direction of powder discharge, at least one of said ribs being positioned above, but close to, said tapered portion.

9. A powder container as claimed in claim 7, wherein said anti-slip members each have a coefficient of friction of 2.5 or above at least on a surface thereof contacting said bag.

10. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means is provided on said bag, said buckling reducing means comprises leg-like auxiliary pieces integral with said tapered portion, said auxiliary pieces comprise excess pieces formed during production of said bag, said auxiliary pieces are heat-sealed over entire range of said auxiliary pieces, said bag is received in a box that is more rigid than said bag, and said bag has folded portions at opposite sides on an end face thereof opposite to said discharging portion, and wherein said buckling reducing means additionally comprises an insertion member provided on said box to be inserted in at least one of said folded portions.

11. A powder container as claimed in claim 10, wherein said insertion member is provided on a side wall of said box that is to be closed after insertion of said bag into said box.

12. A powder container as claimed in claim 10, wherein said insertion member is adhered to said box.

13. A powder container for storing powder and allowing said powder to be discharged, said powder container comprising:

a discharging portion comprising a deformable bag and a tapered portion for discharging the powder;

buckle reducing means for reducing, when said toner container is held in an upright position with said discharging portion facing downward and being fixed, buckling of said tapered portion, wherein said buckling reducing means is provided on said bag, said buckling reducing means comprises leg-like auxiliary pieces integral with said tapered portion, said auxiliary pieces comprise excess pieces formed during production of said bag, said auxiliary pieces are heat-sealed over entire range of said auxiliary pieces, and said bag is received in a box that is more rigid than said bag; and a heat-sealed member position on at least a side of said bag, wherein said buckling reducing means additionally nips said heat-sealed portion in cooperation with said box.

14. A powder container as claimed in claim 13, wherein said buckling reducing means comprises a nipping member provided on a side wall of said box, which is to be closed after insertion of said bag into said box, for nipping said heat-sealed portion in cooperation with said box.

15. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means is provided on said bag, said buckling reducing means comprises leg-like auxiliary pieces integral with said tapered portion, said auxiliary pieces comprise excess pieces formed during production of said bag, said auxiliary pieces are heat-sealed over entire range of said auxiliary pieces, said bag is received in a box that is more rigid than said bag, and said buckling reducing means additionally comprises a shock absorbing piece positioned to substantially fill a space between said bag and said box.

16. A powder container as claimed in claim 15, wherein said shock absorbing piece is adhered to said box beforehand.

17. A powder container as claimed in claim 16, wherein said bag stores the powder.

18. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, and wherein said buckling reducing means comprises leg-like auxiliary pieces integral with said tapered portion.

19. A powder container as claimed in claim 18, wherein said auxiliary pieces are heat-sealed over entire range of said auxiliary pieces.

20. A powder container as claimed in claim 18, wherein said auxiliary pieces comprise excess pieces formed during production of said bag.

21. A powder container as claimed in claim 20, wherein said auxiliary pieces are heat-sealed over entire range of said auxiliary pieces.

22. A powder container as claimed in claim 21, wherein said bag is received in a box that is more rigid than said bag.

23. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means comprises leg-like auxiliary pieces positioned on said tapered portion, said auxiliary pieces comprise excess pieces formed during production of said bag, said auxiliary pieces are heat-sealed over entire range of said auxiliary pieces, said bag is received in a box that is more rigid than said bag, and said buckling reducing means additionally is provided on said box.

24. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means comprises leg-like auxiliary pieces positioned on said tapered portion, said auxiliary pieces comprise excess pieces formed during production of said bag, said auxiliary pieces are heat-sealed over entire range of said auxiliary pieces, said bag is received in a box that is more rigid than said bag, said buckling reducing means is provided on said box, and said buckling reducing means additionally comprises anti-slip members positioned on surfaces of said box, which face said bag, in such a manner as to contact said bag.

25. A powder container as claimed in claim 24, wherein said anti-slip members comprise ribs extending in a direction perpendicular to a direction of powder discharge, at least one of said ribs being positioned above, but close to, said tapered portion.

26. A powder container as claimed in claim 24, wherein said anti-slip members each have a coefficient of friction of 2.5 or above at least on a surface thereof contacting said bag.

27. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means comprises leg-like auxiliary pieces positioned on said tapered portion, said auxiliary pieces comprise excess pieces formed during production of said bag, said auxiliary pieces are heat-sealed over entire range of said auxiliary pieces, said bag is received in a box that is more rigid than said bag, said buckling reducing means is provided on said box, and said bag has folded portions at opposite sides on an end face thereof opposite to said discharging portion, and wherein said buckling reducing means additionally comprises an insertion member provided on said box to be inserted in at least one of said folded portions.

28. A powder container as claimed in claim 27, wherein said insertion member is provided on a side wall of said box that is to be closed after insertion of said bag into said box.

29. A powder container as claimed in claim 27, wherein said insertion member is adhered to said box.

30. A powder container for storing powder and allowing said powder to be discharged, said powder container comprising:

a discharging portion comprising a deformable bag and a tapered portion for discharging the powder;

buckle reducing means for reducing, when said toner container is held in an upright position with said discharging portion facing downward and being fixed, buckling of said tapered portion, wherein said buckling reducing means comprises leg-like auxiliary pieces positioned on said tapered portion, said auxiliary pieces comprise excess pieces formed during production of said bag, said auxiliary pieces are heat-sealed over entire range of said auxiliary pieces, said bag is received in a box that is more rigid than said bag, and said buckling reducing means is provided on said box; and, a heat-sealed member positioned on at least a side of said bag, wherein said buckling reducing means additionally nips said heat-sealed portion in cooperation with said box.

31. A powder container as claimed in claim 30, wherein said buckling reducing means comprises a nipping member provided on a side wall of said box, which is to be closed after insertion of said bag into said box, for nipping said heat-sealed portion in cooperation with said box.

32. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means comprises leg-like auxiliary pieces positioned on said tapered portion, said auxiliary pieces comprise excess pieces formed during production of said bag, said auxiliary pieces are heat-sealed over entire range of said auxiliary pieces, said bag is received in a box that is more rigid than said bag, said buckling reducing means additionally is provided on said box, and said buckling reducing means further comprises a shock absorbing piece positioned to substantially fill a space between said bag and said box.

33. A powder container as claimed in claim 32, wherein said shock absorbing piece is adhered to said box beforehand.

34. A powder container as claimed in claim 33, wherein said bag stores the powder.

35. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said bag is received in a box that is more rigid than said bag, and said buckling reducing means comprises anti-slip members positioned on surfaces of said box, which face said bag, in such a manner as to contact said bag.

36. A powder container as claimed in claim 35, wherein said anti-slip members comprise ribs extending in a direction perpendicular to a direction of powder discharge, at least one of said ribs being positioned above, but close to, said tapered portion.

37. A powder container as claimed in claim 35, wherein said anti-slip members each have a coefficient of friction of 2.5 or above at least on a surface thereof contacting said bag.

38. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said bag is received in a box that is more rigid than said bag, and said bag has folded portions at opposite sides on an end face thereof opposite to said discharging portion, and wherein said buckling reducing means comprises an insertion member provided on said box to be inserted in at least one of said folded portions.

39. A powder container as claimed in claim 38, wherein said insertion member is provided on a side wall of said box that is to be closed after insertion of said bag into said box.

40. A powder container as claimed in claim 38, wherein said insertion member is adhered to said box.

41. A powder container for storing powder and allowing said powder to be discharged, said powder container comprising:

a discharging portion comprising a deformable bag and a tapered portion for discharging the powder;

buckle reducing means for reducing, when said toner container is held in an upright position with said discharging portion facing downward and being fixed, buckling of said tapered portion, wherein said bag is received in a box that is more rigid than said bag; and a heat-sealed member positioned on at least a side of said bag, wherein said buckling reducing means nips said heat-sealed portion in cooperation with said box.

42. A powder container as claimed in claim 41, wherein said buckling reducing means comprises a nipping member provided on a side wall of said box, which is to be closed after insertion of said bag into said box, for nipping said heat-sealed portion in cooperation with said box.

43. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said bag is received in a box that is more rigid than said bag, and said buckling reducing means comprises a shock absorbing piece positioned to substantially fill a space between said bag and said box.

44. A powder container as claimed in claim 43, wherein said shock absorbing piece is adhered to said box beforehand.

45. A powder container as claimed in claim 44, wherein said bag stores the powder.

46. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means is provided on said box.

47. A powder container as claimed in claim 46, wherein said buckling reducing means comprises anti-slip members positioned on surfaces of said box, which face said bag, in such a manner as to contact said bag.

48. A powder container as claimed in claim 47, wherein said anti-slip members comprise ribs extending in a direction perpendicular to a direction of powder discharge, at least one of said ribs being positioned above, but close to, said tapered portion.

49. A powder container as claimed in claim 47, wherein said anti-slip members each have a coefficient of friction of 2.5 or above at least on a surface thereof contacting said bag.

50. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means comprises anti-slip members positioned on surfaces of said box, which face said bag, in such a manner as to contact said bag.

51. A powder container as claimed in claim 50, wherein said anti-slip members comprise ribs extending in a direction perpendicular to a direction of powder discharge, at least one of said ribs being positioned above, but close to, said tapered portion.

52. A powder container as claimed in claim 50, wherein said anti-slip members each have a coefficient of friction of 2.5 or above at least on a surface thereof contacting said bag.

53. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said bag has folded portions at opposite sides on an end face thereof opposite to said discharging portion, and wherein said buckling reducing means comprises an insertion member provided on said box to be inserted in at least one of said folded portions.

54. A powder container as claimed in claim 53, wherein said insertion member is provided on a side wall of said box that is to be closed after insertion of said bag into said box.

55. A powder container as claimed in claim 53, wherein said insertion member is adhered to said box.

56. A powder container for storing powder and allowing said powder to be discharged, said powder container comprising:

a discharging portion comprising a deformable bag and a tapered portion for discharging the powder;

buckle reducing means for reducing, when said toner container is held in an upright position with said discharging portion facing downward and being fixed, buckling of said tapered portion; and, a heat-sealed member positioned on at least a side of said bag, wherein said buckling reducing means nips said heat-sealed portion in cooperation with said box.

57. A powder container as claimed in claim 56, wherein said buckling reducing means comprises a nipping member provided on a side wall of said box, which is to be closed after insertion of said bag into said box, for nipping said heat-sealed portion in cooperation with said box.

58. A powder container for storing powder and allowing said powder to be discharged, said powder container comprising:

a discharging portion comprising a deformable bag and a tapered portion for discharging the powder; and buckle reducing means for reducing, when said toner container is held in an upright position with said discharging portion facing downward and being fixed, buckling of said tapered portion, wherein said buckling reducing means comprises a shock absorbing piece positioned to substantially fill a space between said bag and said box.

59. A powder container as claimed in claim 58, wherein said shock absorbing piece is adhered to said box beforehand.

60. A powder container as claimed in claim 59, wherein said bag stores the powder.

61. A powder container comprising:

a deformable bag storing powder; and position maintaining means for maintaining a position of said bag, wherein said bag comprises a powder outlet for discharging the powder and is tapered toward said powder outlet, said position maintaining means maintains said bag in an upright position with said powder outlet facing downward, said position maintaining means maintains the upright position of said bag on the basis of rigidity, and said position maintaining means comprises a support member integral with an outer periphery of said bag in an upright position.

62. A powder container comprising:

a deformable bag storing powder; and position maintaining means for maintaining a position of said bag, wherein said bag comprises a powder outlet for discharging the powder and is tapered toward said powder outlet, said position maintaining means maintains said bag in an upright position with said powder outlet facing downward, said position maintaining means maintains the upright position of said bag on the basis of rigidity, and said position maintaining means comprises an upright member mounted on an inner periphery of said bag.

63. A powder container comprising:

a deformable bag storing powder; and position maintaining means for maintaining a position of said bag, wherein said bag comprises a powder outlet for discharging the powder and is tapered toward said powder outlet, and said position maintaining means comprises a member adhered to said bag.

64. A powder container comprising:

a deformable bag storing powder; and position maintaining means for maintaining a position of said bag, wherein said bag comprises a powder outlet for discharging the powder and is tapered toward said powder outlet, and said position maintaining means comprises a thickened wall portion of said bag.

65. A powder container comprising:

a deformable bag storing powder; and position maintaining means for maintaining a position of said bag, wherein said bag comprises a powder outlet for discharging the powder and is tapered toward said powder outlet, and said position maintaining means comprises a gas fed into said bag.

66. A powder container comprising:

a deformable bag storing powder; and position maintaining means for maintaining a position of said bag, wherein said position maintaining means maintains the upright position of said bag on the basis of rigidity, and said position maintaining means comprises a support member integral with an outer periphery of said bag in an upright position.

67. A powder container comprising:

a deformable bag storing powder; and position maintaining means for maintaining a position of said bag, wherein said position maintaining means maintains the upright position of said bag on the basis of rigidity, and said position maintaining means comprises an upright member integral with an inner periphery of said bag.

68. A powder container comprising:

a deformable bag storing powder; and position maintaining means for maintaining a position of said bag, wherein said position maintaining means maintains the upright position of said bag on the basis of rigidity, and said position maintaining means comprises a support member integral with an outer periphery of said bag in an upright position.

69. A powder container comprising:

a deformable bag storing powder; and position maintaining means for maintaining a position of said bag, wherein said position maintaining means maintains the upright position of said bag on the basis of rigidity, and said position maintaining means comprises an upright member mounted on an inner periphery of said bag.

70. A powder container comprising:

a deformable bag storing powder; and position maintaining means for maintaining a position of said bag, wherein said position maintaining means comprises a member adhered to said bag.

71. A powder container comprising:

a deformable bag storing powder; and position maintaining means for maintaining a position of said bag, wherein said position maintaining means comprises a thickened wall portion of said bag.

72. A powder container comprising:

a deformable bag storing powder; and position maintaining means for maintaining a position of said bag, wherein said position maintaining means comprises a gas fed into said bag.

73. In a powder discharging device for discharging coloring powder from a powder container via an outlet formed in said powder container, said powder container comprises:

a deformable bag storing the coloring powder;

position maintaining means for maintaining a position of said bag; and a mounting portion for removably mounting said bag;

wherein a gas is fed into said bag in order to fluidize the coloring powder and cooperates with said position maintaining means to maintain the position of said bag.

74. A device as claimed in claim 73, wherein said position maintaining means is provided on said bag.

75. A device as claimed in claim 73, wherein said position maintaining means is provided on said mounting portion.

76. A device as claimed in claim 75, further comprising adjusting means for adjusting pressure inside said bag.

77. A device as claimed in claim 76, wherein said adjusting means comprises a filter member that passes the gas, but blocks the powder.

78. A device as claimed in claim 75, wherein the gas is fed to said bag in an amount, which substantially inflates said bag, in accordance with an amount of adjustment available with said adjustment means.

79. A device as claimed in claim 73, wherein an amount of the gas to be fed into said bag is greater than an amount to flow out of said bag when the coloring powder is to be discharged.

80. A device as claimed in claim 79, wherein the gas is fed to said bag in an amount, which substantially inflates said bag, in accordance with an amount of adjustment available with said adjustment means.

81. A device as claimed in claim 79, wherein said adjusting means comprises a filter member that passes the gas, but blocks the powder.

82. A device as claimed in claim 73, further comprising adjusting means for adjusting pressure inside said bag.

83. A device as claimed in claim 82, wherein said adjusting means comprises a filter member that passes the gas, but blocks the powder.

84. A device as claimed in claim 73, wherein the gas is fed to said bag in an amount, which substantially inflates said bag, in accordance with an amount of adjustment available with said adjustment means.

85. In an image forming apparatus constructed to transfer coloring powder from a powder container to a developing unit via a powder outlet formed in said powder container by using a powder discharging device, said powder container comprises:

a deformable bag storing the coloring powder;

position maintaining means for maintaining a position of said bag; and a mounting portion for removably mounting said bag;

wherein a gas is fed into said bag in order to fluidize the coloring powder and cooperates with said position maintaining means to maintain the position of said bag.

86. In a powder discharging device for discharging coloring powder from a powder container via an outlet formed in said powder container, said powder container comprises:

a deformable bag storing the coloring powder;

a position maintaining device configured to maintain a position of said bag; and a mounting portion configured to removably mount said bag;

wherein a gas is fed into said bag in order to fluidize the coloring powder and cooperates with said position maintaining device to maintain the position of said bag.

87. In an image forming apparatus constructed to transfer coloring powder from a powder container to a developing unit via a powder outlet formed in said powder container by using a powder discharging device, said powder container comprises:

a deformable bag storing the coloring powder;

a position maintaining device configured to maintain a position of said bag; and a mounting portion for removably mounting said bag;

wherein a gas is fed into said bag in order to fluidize the coloring powder and cooperates with said position maintaining device to maintain the position of said bag.

* * * * *